US008983348B2

(12) United States Patent
Kobashigawa et al.

(10) Patent No.: US 8,983,348 B2
(45) Date of Patent: Mar. 17, 2015

(54) FIXING DEVICE AND IMAGE FORMING APPARATUS INCLUDING SAME

(71) Applicants: Shota Kobashigawa, Kanagawa (JP); Susumu Matsusaka, Kanagawa (JP); Miwa Shuto, Kanagawa (JP); Masanobu Yamagata, Kanagawa (JP); Motokazu Hasegawa, Kanagawa (JP); Yukari Isoe, Kanagawa (JP)

(72) Inventors: Shota Kobashigawa, Kanagawa (JP); Susumu Matsusaka, Kanagawa (JP); Miwa Shuto, Kanagawa (JP); Masanobu Yamagata, Kanagawa (JP); Motokazu Hasegawa, Kanagawa (JP); Yukari Isoe, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/161,337

(22) Filed: Jan. 22, 2014

(65) Prior Publication Data

US 2014/0205331 A1 Jul. 24, 2014

(30) Foreign Application Priority Data

Jan. 22, 2013 (JP) ..... 2013-009109
Jan. 29, 2013 (JP) ..... 2013-014194

(51) Int. Cl.
*G03G 15/20* (2006.01)

(52) U.S. Cl.
CPC ..... *G03G 15/2053* (2013.01)
USPC ..... 399/328; 399/329

(58) Field of Classification Search
USPC ..... 399/107, 110, 122, 320, 328, 329; 219/216, 619
See application file for complete search history.

(56) References Cited

U.S. PATENT DOCUMENTS 7,835,680 B2 * 11/2010 Nanjo et al. ..... 399/329
2006/0285893 A1 12/2006 Ishii

FOREIGN PATENT DOCUMENTS

| | | |
|---|---|---|
| JP | 9-016006 | 1/1997 |
| JP | 2000-056598 | 2/2000 |
| JP | 2000-105516 | 4/2000 |
| JP | 2002-116656 | 4/2002 |
| JP | 2004-094266 | 3/2004 |
| JP | 2006-285126 | 10/2006 |
| JP | 2006-350054 | 12/2006 |
| JP | 2008-009169 | 1/2008 |

* cited by examiner

*Primary Examiner* — Hoan Tran
(74) *Attorney, Agent, or Firm* — Oblon, Spivak, McClelland, Maier & Neustadt, L.L.P.

(57) ABSTRACT

A fixing device that includes a rotary fixing member; a pressure roller configured to press against the fixing member to form a nip with the fixing member; and an induction heating unit as a heat source to heat the fixing member. The induction heating unit includes an excitation coil; a coil retainer to hold the excitation coil; and a cover member disposed opposite the coil retainer in an opposite side of the rotary fixing member, in which the cover member protrudes toward a central predetermined range of the excitation coil in an axial direction of the rotary fixing member to effectively cool the fixing device. The induction heating unit further includes a rectifying member to effectively cool the fixing device.

20 Claims, 19 Drawing Sheets

FIXING DEVICE AND IMAGE FORMING APPARATUS INCLUDING SAME

CROSS-REFERENCE TO RELATED APPLICATIONS

The present application claims priority pursuant to 35 U.S.C. §119 from Japanese patent application numbers 2013-009109 and 2013-014194, filed on Jan. 22, 2013 and Jan. 29, 2013, respectively, the entire disclosures of which are incorporated by reference herein.

BACKGROUND

1. Technical Field

The present invention relates to a fixing device, and in particular to the fixing device employing an electromagnetic induction heating method to fix an unfixed image on a recording medium, and an image forming apparatus including such a fixing device.

2. Related Art

Conventionally, an image forming apparatus such as a copier, a printer, and the like, employs a fixing device employing electromagnetic induction, which is both fast and energy-efficient.

For example, JP-2006-350054-A discloses a fixing device employing the electromagnetic induction heating method, which includes a support roller as a heat roller to generate heat, a fixing support roller as a fixing roller, a fixing belt stretching around the support roller and the fixing support roller, an induction heater disposed opposite the support roller via the fixing belt, and a pressure roller pressing against the fixing support roller via the fixing belt. The induction heater is formed of a coil such as an excitation coil wound in the longitudinal direction and a core disposed opposite the coil. The fixing belt is configured to be heated at a portion opposite the induction heater. The thus-heated fixing belt heats to fix a toner image formed on a recording medium conveyed to a position opposite the fixing support roller and the pressure roller.

More specifically, when a high-frequency alternating current is supplied to the coil, an alternate magnetic field is formed around the coil, and an eddy current is generated near the surface of the support roller. When the eddy current is generated to the support roller as a heat roller, joule heat is generated due to electric resistance of the support roller itself. With its joule heat, the fixing belt wound around the support roller is heated. The fixing device employing the electromagnetic induction heating method as described above is known as a device with high-thermal conversion efficiency and less energy consumption, if compared to a conventional halogen heater, capable of increasing a surface temperature of the fixing belt up to a prescribed level in a short time because a heat generator used in the electromagnetic induction fixing device is directly heated by the method.

However, as to the fixing device employing the induction heating method, because the high-frequency alternating current is supplied to the coil, the temperature of the excitation coil rises from joule heat generated due to electrical resistance of the excitation coil. As a result, there is a concern that UL Standards for Safety are not observed due to the increase in the temperature of the coil or the excitation coil is broken.

As an approach to solve the above problem, a technology is known in which the excitation coil is cooled using a cooling fan. For example, JP-2000-105516-A discloses a fixing device including an insulation member between the excitation coil and the fixing roller so that the cooling efficiency of the cooling fan is improved. However, in the fixing device employing the induction heating method the coil temperature has a tendency to rise more quickly than in the conventional device when, for example, used in a high-speed printer capable of printing speeds of more than 60 cpm (copies per minute) because of an increase in the continued printing time and a high power input for the elevated temperature for short-time start-up. Currently, there is no other way to increase the power of the cooling fan in order to increase cooling efficiency, which causes problems of cost increase, increased energy consumption, increased noise, and the like.

SUMMARY

The present invention provides an improved fixing device that includes a rotary fixing member; a pressure roller pressed against the fixing member to form a nip in association with the fixing member; and an induction heating unit, as a heat source, to heat the fixing member. The induction heating unit further includes an excitation coil; a coil retainer to hold the excitation coil; and a cover member disposed opposite the coil retainer in an opposite side of the fixing member. In such an induction heating unit, a distance between the coil retainer and the cover member is narrower in a central predetermined range of the excitation coil in an axial direction of the fixing member than other portions.

These and other objects, features, and advantages will become apparent upon consideration of the following description of the preferred embodiments when taken in conjunction with the accompanying drawings.

DETAILED DESCRIPTION

Hereinafter, preferred embodiments will be described with reference to accompanying drawings.

Figure 1:
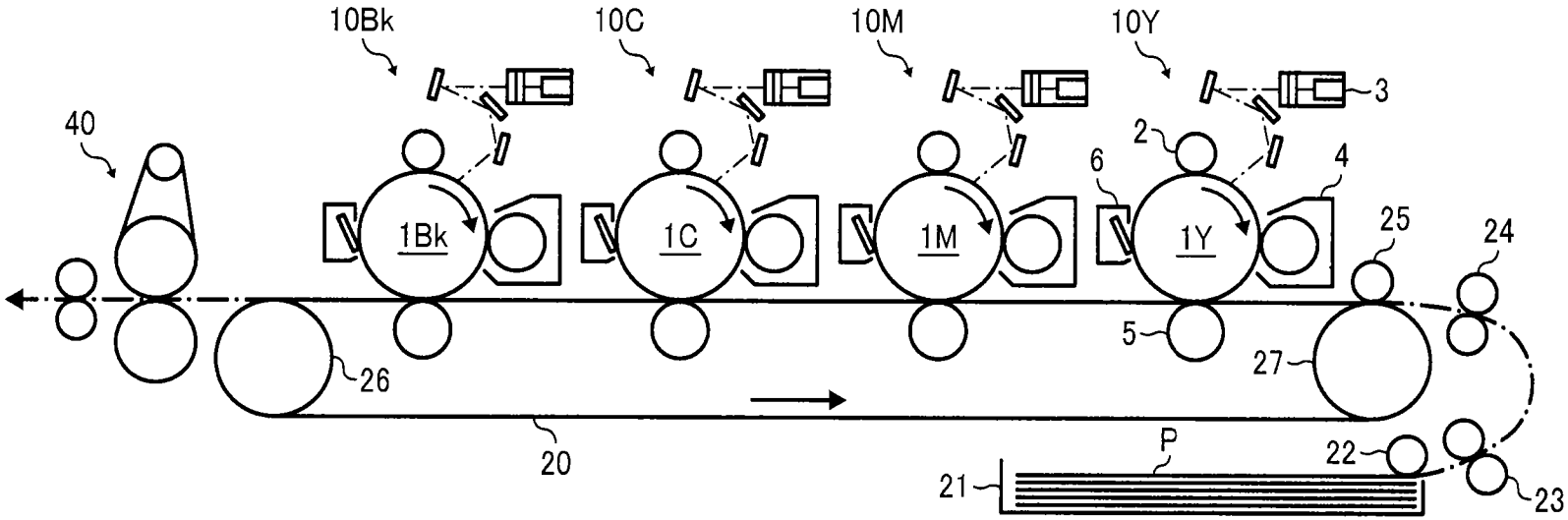
FIG. 1 illustrates a schematic structure of an image forming apparatus including a fixing device according to a first embodiment.

FIG. 1 is a schematic cross-sectional view of an image forming apparatus including a fixing device according to embodiments. Hereinafter, a structure and operation of the image forming apparatus will be described with reference to FIG. 1.

The image forming apparatus is a printer that employs an electrophotographic method and includes four sets of image forming units 10Y, 10M, 10C, and 10Bk, each mainly including photoreceptor drums 1Y, 1M, 1C, and 1Bk as an image carrier, so that a full-color image using four colors of toner, yellow (Y), magenta (M), cyan (C), and black (Bk) can be formed. However, the structure of the image forming apparatus is not limited to the illustrated example alone. For example, the illustrated printer herein employs a direct transfer method, in which a toner image is directly transferred onto a recording medium such as a sheet; however, the printer may employ an indirect transfer method, in which the toner image is transferred to the sheet via an intermediate transfer member. In addition, the number or order of colors can be varied. Further, the present invention is not limited to a printer but is applicable to a copier, a facsimile machine, or a multi-function apparatus having one or more capabilities of the above devices.

As illustrated in FIG. 1, the four sets of image forming units 10Y, 10M, 10C, and 10Bk are disposed in parallel along an upper surface of a conveyance belt 20, to thus form a tandem-type image forming section. The conveyance belt 20 is stretched around a driving roller 26 and a driven roller 27 and rotates in the direction of the arrow in the figure. A paper tray 21 to contain a sheet P as a recording medium is disposed beneath the conveyance belt 20. The sheet P fed from a sheet feed roller pair 22 is conveyed by a conveyance roller pairs 23, 24 guided by a guide member, not shown, and is conveyed. The thus-conveyed sheet P is then fed to an upper surface of the conveyance belt 20 through an inlet portion where a bias roller 25 is disposed opposite the driven roller 27 and is conveyed by being electrostatically attracted to the conveyance belt 20. Then, toner images are sequentially transferred from the image forming units 10Y, 10M, 10C, and 10Bk in the tandem image forming section to the sheet P that is conveyed by the conveyance belt 20. The sheet carrying an unfixed toner image thereon is conveyed from the conveyance belt 20 to a fixing device 40, and the fixing device 40 fixes the toner image onto the sheet with heat and pressure.

The four sets of image forming units 10Y, 10M, 10C, and 10Bk each are similar in the structure. Therefore, the extreme upstream image forming unit 10Y is taken as representative and is described in detail below. For simplicity, reference numerals for the image forming units 10M, 10C, and 10Bk other than the yellow image forming unit 10Y are omitted. In addition, suffixes representing different colors Y, M, and C will also be omitted in the explanation below.

Each image forming unit 10 includes a central photoreceptor drum 1 rotatably contacting the conveyance belt 20. Around a circumference of the photoreceptor drum 1 are disposed a charger 2, an exposure device 3, a developing device 4, a transfer roller 5, a cleaner 6, and a discharger, not shown, in this order along a rotation direction of the photoreceptor drum 1. The charger 2 charges a surface of the photoreceptor drum 1 to have a predetermined electric potential. The exposure device 3 exposes the charged drum surface based on color-decomposed image signals and forms an electrostatic latent image on the surface of the drum. The developing device 4 supplies toner to develop the electrostatic latent image formed on the drum surface and renders the latent image visible. The transfer roller 5 transfers the developed toner image on the sheet conveyed via the conveyance belt 20. The cleaner 6 removes residual toner remaining, without being used in the transfer, on the surface of the drum. The discharger, not shown, removes any electrical charge remaining on the surface of the drum.

Next, the fixing device according to an embodiment will be described with reference to FIG. 2.

Figure 2:
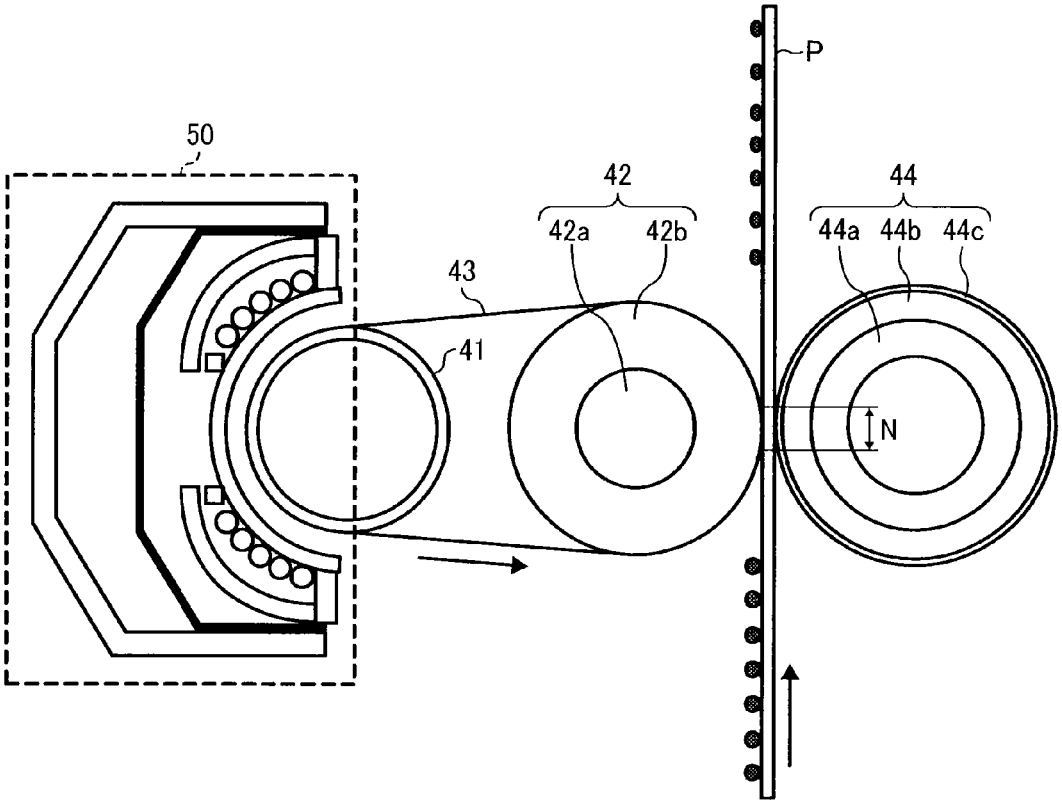
FIG. 2 illustrates a cross-sectional view of the fixing device according to the first embodiment.

FIG. 2 is a schematic cross-sectional view of a fixing device employing induction heating method, which can be used as the fixing device 40 in the printer schematically illustrated in FIG. 1. As illustrated in FIG. 2, the fixing device 40 includes a heat roller 41, a fixing roller 42, a fixing belt 43, a pressure roller 44, and an induction heating unit 50.

The heat roller 41 includes a metal core formed of non-magnetic stainless steel, having a thickness of from 0.2 to 1.0 mm. The heat roller 41 includes a heat-generating layer formed of Cu having a thickness of from 3 to 15 μm on the surface thereof, to thus improve the heat-generating effect. In this case, nickel coating is preferably applied on the surface of the Cu layer for preventing corrosion. Alternatively, any magnetic shunt alloy with a Curie point of approximately 160 to 220 degrees C. may be used. In this case, the magnetic shunt alloy can be used as a heat-generating layer, or alternatively, a Cu layer of from 3 to 15 μm may be formed, as a heat-generating layer, on the surface of the magnetic shunt alloy. Because the magnetic shunt alloy includes aluminum, temperature increase stops around the Curie point.

The fixing roller 42 includes a metal core 42*a* formed of, for example, stainless steel, carbon steel, or the like, and an elastic material 42*b* covering the metal core with solid or foamed silicon rubber having heat resistivity. Then, the pressure roller 44 presses against the fixing roller 42, so that a contact portion, that is, a fixing nip N, having a predetermined width, is formed between the pressure roller 44 and the fixing roller 42. An external diameter of the fixing roller 42 is from 30 to 40 mm, the thickness of the elastic material 42*b* is from 3 to 10 mm, and the roller hardness is from 10 to 50 degrees according to Japanese Industrial Standards Class A (JTS-A).

Figure 3:
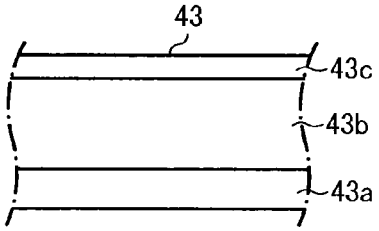
FIG. 3 is a cross-sectional view illustrating a structure of a fixing belt.

The fixing belt 43 serving as a fixing member is stretched around the heat roller 41 and the fixing roller 42. The fixing belt 43 according to the present embodiment as illustrated in FIG. 3 includes a base 43*a*, an elastic layer 43*b*, and a release layer 43*c*. The elastic layer 43*b* and the release layer 43*c* are laminated on the base 43*a*.

Properties required for the base 43*a* include mechanical strength required when stretched around the rollers, flexibility, and heat resistivity capable of withstanding the fixing temperature. In the present embodiment, the base 43*a* to induction-heat the heat roller 41 is preferably formed of insulating heat-resistant resins, such as polyimide, polyamideimide, polyetheretherketone (PEEK), polyethersulfone (PES), polyphenylene sulfide (PPS), fluorine resins, and the like. The thickness thereof is from 30 to 200 μm for thermal capacity and strength.

The elastic layer 43*b* is provided to give flexibility to the surface of the belt so as to obtain a uniform image without uneven glossiness, and preferably has a rubber stiffness of from 5 to 50 degrees (according to JIS-A), and a thickness ranging from 50 to 500 μm. In addition, preferable materials include silicon rubbers, fluorosilicon rubbers, and the like, for obtaining heat resistivity for the fixing temperature.

Materials used for the release layer 43*c* include fluorin resins such as: polytetrafluoroethylene (PTFE); tetrafluoroethylene-perfluoroalkyl vinylether copolymer (PFA); and tetrafluoroethylene-hexafluoropropylene copolymer (FEP), or mixture of these resins, or heat-resistant resins dispersed with above resins.

When the elastic layer 43*b* is coated with the release layer 43*c*, toner can be released easily and paper dust can be prevented from sticking without using silicon oil and the like, and an oil-less structure is enabled. However, resins having good releaseability usually have no elasticity like a rubber material, so that if the thick release layer is formed on the elastic layer, elasticity of the belt surface forming the release layer is lost, thereby generating uneven glossiness in the output image. To strike the optimum balance between releaseability and elasticity, the thickness of the release layer 43*c* preferably ranges from 5 to 50 μm and is more preferably from 10 to 30 μm.

In addition, if necessary, a primer or undercoat layer is disposed between adjacent layers. Further, a layer to improve durability against slidable movement can be disposed on an interior surface of the base 43*a*.

The base 43*a* may include a heat-generating layer. For example, a layer in which a Cu layer having a thickness of 3 to 15 μm is formed on the base layer formed of polyimide can be used as a heat-generating layer.

The pressure roller 44 is formed of a release layer 44*c*, an elastic layer 44*b* having a high heat resistance, and a metal core 44*a* including a metallic cylinder portion. The pressure roller 44 presses against the fixing roller 42 via the fixing belt 43, so that a fixing nip N is formed at the pressed portion. An outer diameter of the pressure roller is set to approximately 30 to 40 mm and the elastic layer 44*b* has a layer thickness of 0.3 to 5 mm and has an Asker stiffness of 20 to 50 degrees. A favorable material for the pressure roller 44 is silicon rubber due to the need for heat resistance. Further, in order to improve releaseability when duplex printing is performed, the release layer 44*b* formed of fluorine resins and having a layer thickness of 10 to 100 μm is disposed on the elastic layer 44*b*.

Because the stiffness of the pressure roller 44 is greater than that of the fixing roller 42, so that the pressure roller 44 bites into the fixing roller 42 and the fixing belt 43. As a result, the recording medium that is conveyed along the fixing belt 43 is distorted on the way out of the fixing nip and has a curvature relative to the surface of the fixing belt 43, and thus, the releaseability of the recording medium is increased.

Figure 4A:
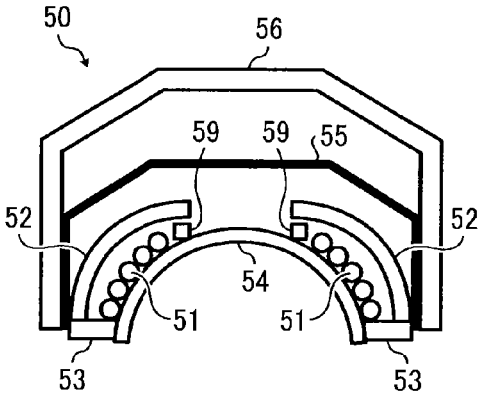
FIGS. 4A and 4B are views each illustrating a structure of an induction heating unit.
Figure 4B:
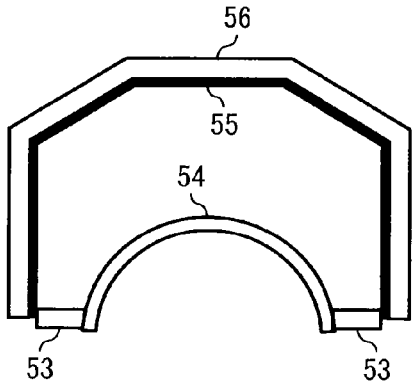

FIGS. 4A and 4B are cross-sectional views each illustrating a structure of the induction heating unit 50. FIG. 4A shows a cross-sectional view of the induction heating unit 50 perpendicular to a rotary axis of the heat roller 41 around the center in the longitudinal direction thereof, and FIG. 4B shows a cross-sectional view perpendicular to the rotary axis at the end in the longitudinal direction thereof. Specifically, the positions in the longitudinal direction of each of FIGS. 4A and 4B correspond respectively to positions A and B in FIG. 7, which will be described below.

As illustrated in FIG. 4A being a cross-sectional view taken at around the center in the longitudinal direction, the induction heating unit 50 includes an excitation coil 51 (which may be referred to simply as a coil 51), magnetic cores 52, 53, and 59, a coil retainer 54, an aluminum cover 55 serving both as a rectifying member and an electromagnetic wave shield, and a resinous cover 56. The shape of the aluminum cover 55 in FIG. 4A is different from the one in FIG. 4B because the cross-sectional position taken along the axial direction is different. Details of the aluminum cover 55 will be described later referring to FIG. 7 and the like.

The magnetic cores disposed to cover the coil 51 include side cores 53 as first cores, arch cores 52 as second cores, and center cores 59 as third cores, and form a magnetic path to concentrate magnetic fluxes generated by the coil 51 to the heat roller 41. The arch cores 52 are positioned opposed to the circumferential surface of the heat roller 41 and in the back of the coil 51. The side cores 53 are positioned opposed to the circumferential surface of the heat roller 41 without intermediary of the coil 51 and nearer to the heat roller 41 than to the arch cores 52. Each center core 59 is positioned at a center end of the arch core 52 and between the arch core 52 and the coil retainer 54.

Preferred materials for magnetic cores such as an arch core 52, a side core 53, and a center core 59 are those having less coercive force and high electrical resistivity. Preferred materials for the cores 52, 53, and 59 are ferrite or permalloys such as Mn—Zn ferrite and Ni—Zn ferrite.

Figure 5:
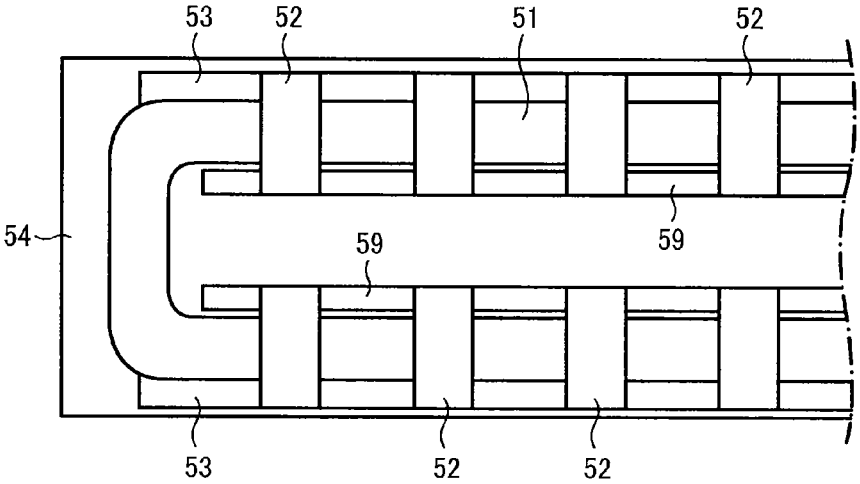
FIG. 5 illustrates an induction heating unit including an excitation coil and core members.

In addition, as illustrated in FIG. 5, the side cores 53 and the center cores 59 are plate-like or bar-shaped cores extending in the longitudinal direction, i.e., in the axial direction of the heat roller 41. By contrast, as illustrated in FIG. 4A, the arch cores 52 are arch-shaped along the circumference of the heat roller 41 if seen from the axial direction of the heat roller 41, and multiple arch cores 52 are disposed at appropriated intervals in the roller longitudinal direction (see FIG. 5), so that the temperature distribution in the longitudinal direction of the heat roller 41 becomes uniform.

The coil 51 is formed such that 50 to 500 electrical leads, to which insulation coating is applied, each having a diameter of from approximately 0.05 to 0.2 mm are wound together to form a litz wire, which is wound 5 to 15 times. The litz wire includes a fusion layer on its surface thereof. The fusion layer is solidified by being heated electrically or heated in a constant temperature reservoir, and thus, the shape of the wound coil can be maintained. Alternatively, the litz wire without the fusion layer is wound and can be shaped by press molding. Preferable materials as insulation and covering materials for the base wire of the litz wire include resins such as polyamideimide, polyimide, and the like having both heat resistance and insulation property. According to the present embodiment, use of polyester and polyesterimide having less heat resistance than the conventional ones is intended to improve cooling efficiency of the coil 51. The finished coil 51 is attached to the coil retainer 54 using a silicon adhesive or the like. The coil retainer 54 requires heat-resistance to a temperature exceeding the fixing temperature and is preferably formed with highly heat-resistant resins such as PET or crystal liquid polymers.

The aluminum cover 55 and the resinous cover 56 are disposed at an opposite side of the fixing member (herein, the fixing belt 43) and facing the coil retainer 54. The aluminum cover 55 serves as both an electromagnetic wave shield and a rectifying member. Specifically, the aluminum cover 55 shields electromagnetic wave from the coil 51 and prevents a portion around the coil from being heated due to an influence of the electromagnetic wave. Accordingly, preferred materials as the electromagnetic wave shield are non-magnetic and electrically conductive ones. In the present embodiment, aluminum is used, but alternatively copper, gold, silver, and the like may be used. In addition, the aluminum cover 55 serving as a rectifier adjusts, or rectifies, a flow of air inside the induction heating unit 50, which will be described later below, and improves efficiency to cool the coil 51. The aluminum cover 55 as a rectifier is formed of any thermally conductive material so as to promote heat discharge from the coil 51 during operation. To reduce the fluid resistance, a surface of the aluminum cover 55 is preferably smoothed. Accordingly, preferred materials for the rectifier include, other than aluminum used herein, metals such as copper and iron having good thermal conductivity. If the resin is not expected to serve as an electromagnetic shield is not expected, resins having a smoothed surface may be used. The resinous cover 56 serves to house the induction heating unit 50, and therefore, highly heat-resistant resins such as PET or crystal liquid polymers are preferred.

Figure 6:
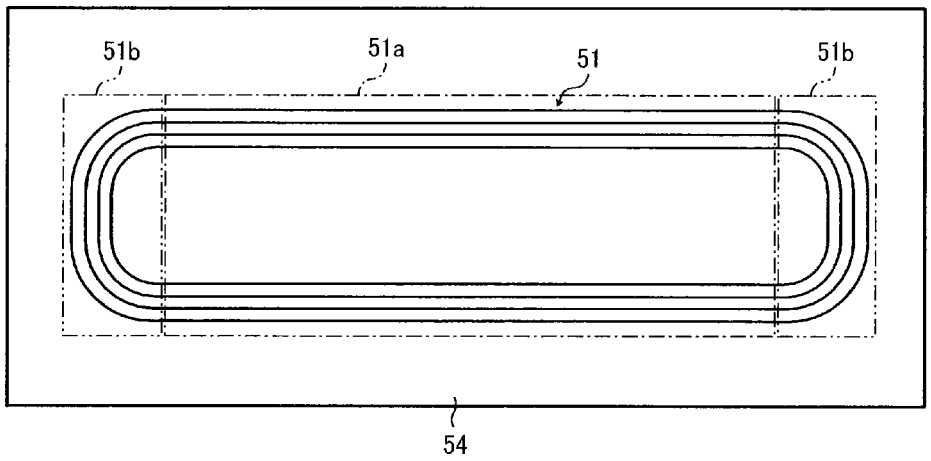
FIG. 6 is a top view illustrating a state in which the excitation coil is fixed on a coil retainer.
Figure 7:
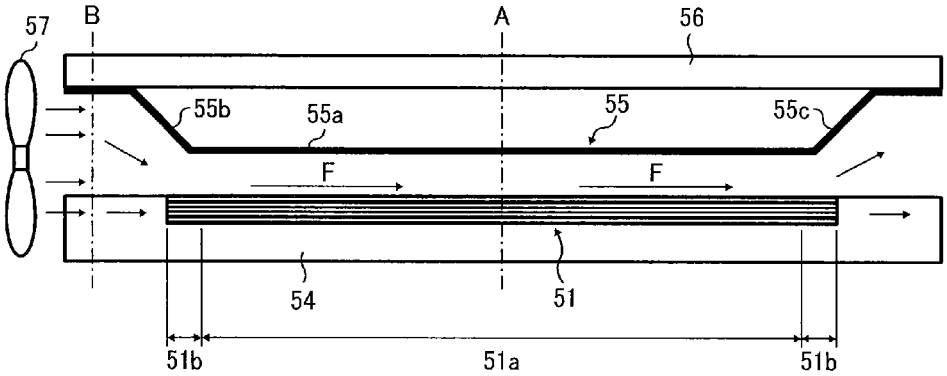
FIG. 7 illustrates a cross-sectional view of the induction heating unit seen from a longitudinal direction thereof.

Referring to FIGS. 6 and 7, a structure of the induction heating unit 50 will be described in detail.

FIG. 6 is a top view illustrating that the coil 51 is fixed on the coil retainer 54 (see FIGS. 4A and 4B as cross-sectional views). FIG. 7 illustrates a cross-sectional view of the induction heating unit 50 seen laterally from a longitudinal direction thereof.

FIG. 6 illustrates for simplification the coil 51 as if a plurality of coils is arranged elliptically. In the present embodiment, the coil 51 is formed such that 90 insulated copper wires each having an outer diameter of 0.15 mm are wound together and the thus-wound wire bundle is disposed spirally to cover an entire width of the surface of the coil retainer 54. The coil retainer 54 covers the heat roller 41 as a heat generator. In addition, the coil 51 is shaped to wind in the roller rotary axis direction along the circumference of the fixing belt 3. In this case, a central portion of the coil 51 opposite the heat roller 41 and parallel to the rotary axis direction of the heat roller 41 is a linear portion 51*a*; and portions at both ends of the coil 51 each forming substantially a semicircle are curved portions 51*b*.

As illustrated in FIG. 7, the linear portion 51*a* is fixed to the coil retainer 54 and the aluminum cover 55 and the resinous cover 56 are disposed opposite the linear portion 51*a*. A cooling fan 57 is disposed at one end of the induction heating unit 50, and sends air between the coil retainer 54 and covering members (including the aluminum cover 55 and the resinous cover 56), so that the coil 51 heated during the operation of the induction heating unit 50 is air-cooled. In the present embodiment, the cooling fan 57 is disposed at one lateral side of the induction heating unit 50. Alternatively, a flow path such a duct may be disposed between the fan and the induction heating unit 50. The induction heating unit 50 is air-cooled via the flow path. The cooling fan may be either disposed at the fixing device or mounted to the image forming apparatus. In the latter case, cooled air generated by the cooling fan is sent to the induction heating unit 50 from the image forming apparatus.

As illustrated in FIG. 7, the aluminum cover 55 serving as the rectifying member has a center portion expanded downward in the direction to the coil retainer 54 which forms a projecting portion 55*a*. Accordingly, the coil retainer 54 is closer to the aluminum cover 55 in the center portion than in the end portions. More specifically, the distance between the projecting portion 55*a* and the coil retainer 54 is substantially 60 to 80% of the distance in the end portions. With the configuration as above, speed of an airflow F near the linear portion 51*a* during the operation of the cooling fan 57 is increased in accordance with narrowing of the flow path, thereby improving the cooling effect to the coil 51 as a whole.

Figure 8:
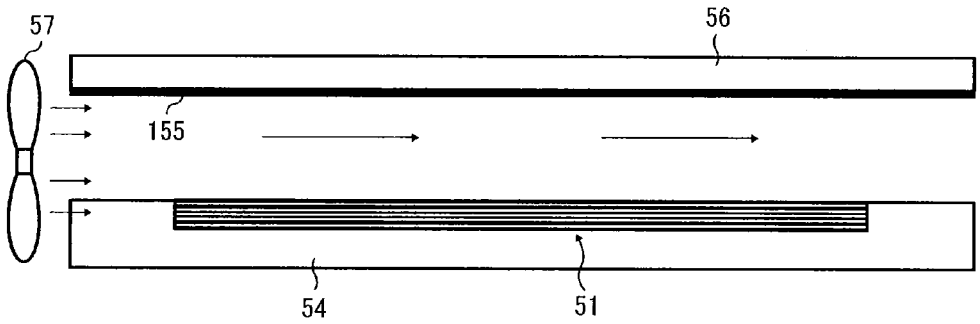
FIG. 8 is a cross-sectional view illustrating a structure of the induction heating unit according to a first comparative example.

FIG. 8 illustrates a comparative example 1 for a comparison, in which an aluminum cover 155 is parallel to the coil retainer 54, so that the cross-sectional area of the airflow path is substantially the same overall in the induction heating unit 50. As a result, an increase in the airflow speed is not expected and the cooling effect is inferior to that of the present embodiment.

In addition, in the first embodiment as illustrated in FIG. 7, a front portion 55*b* of the projecting portion 55*a* of the aluminum cover 55 at a side nearer to the cooling fan 57 is formed as a slanted surface connecting the downwardly expanding projecting portion 55*a* with the upper ceiling portion, that is, the resinous cover 56. Herein, the slanted surface has a slant relative to the coil retainer 54 and has a smoothed surface. Because the front portion 55*b* of the aluminum cover 55 is a slanted surface, the fluid resistance of the aluminum cover 55 relative to the airflow from the cooling fan 57 is reduced, thereby increasing the cooling efficiency. This is because, if the fluid resistance lowers, the speed of the airflow F in the projecting portion 55*a* increases, heat conduction coefficient between the coil 51 and the airflow F increases, thereby increasing the heat discharge.

Figure 9:
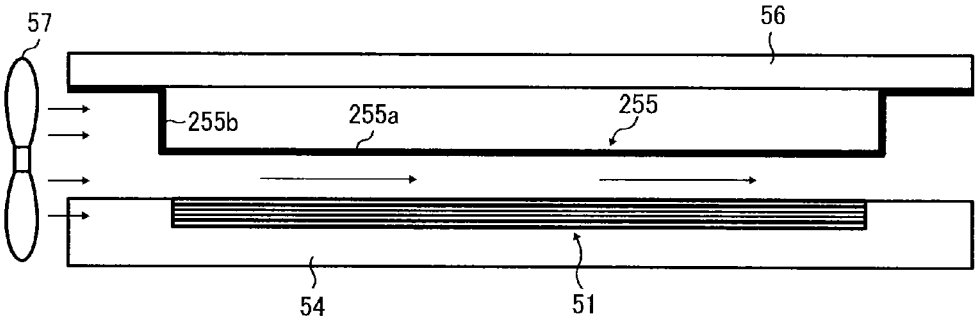
FIG. 9 is a cross-sectional view illustrating a structure of the induction heating unit according to a second comparative example.

By contrast, in the comparative example 2 as illustrated in FIG. 9, if a front surface 255*b* of a central portion 255*a* of an aluminum cover 255 protrudes perpendicularly or with angles near the right angle to the airflow path, the fluid resistance increases, thereby decreasing the cooling efficiency.

In addition, as another effect of the reduction of the fluid resistance in the first embodiment, small static pressure of the cooling fan 57 is sufficient to generate a satisfactory airflow even using a small fan, and moreover a general-purpose cooling fan can be used.

Further, in the first embodiment, because the front portion 55*b* is disposed opposite the curved portions 51*b*, thereby increasing the speed of the airflow F overall in the linear portion 51*a* and increasing the cooling efficiency. In addition, as illustrated in FIG. 7, because the air flowing obliquely downward in the curved portions 51*b* nearer to the cooling fan 57, easily strikes the coil, thereby further increasing the cooling efficiency.

A predetermined range of the central portion in which a distance between the coil retainer 54 and the aluminum cover 55 is narrowed may be varied; however, the range preferably at least corresponds to the range of the linear portion 51*a*. With this configuration, the linear portion 51*a* can be entirely and efficiently cooled. Alternatively, the central predetermined range can be set larger than the entire length of the linear portion 51*a* so as to stick out in the curved portions 51*b*. As illustrated in FIG. 7, the projecting portion 55*a* of the aluminum cover 55 extends slightly from linear portion 51*a* to the curved portions 51*b*.

Further, the front portion 55*b* of the aluminum cover 55 can be formed as a slant extending to an opposite end in the longitudinal direction. A degree of the slant and the position where the slant starts in the slanted surface may be varied. In addition, a rear surface 55*c* of the projecting portion 55*a* of the aluminum cover 55 can be formed as a slanted surface similar to the front portion 55*b* or alternatively as a right angle or a surface with a steep angle. Further, the rear surface 55*c* may be a slanted surface extending up to the opposite end in the longitudinal direction. As such, various forms are possible.

Next, an operation of the thus-configured fixing device will be described.

The fixing belt 43 rotates in the direction indicated by an arrow in FIG. 2, i.e., in the counterclockwise direction. The heat roller 41 is heated by the induction heating unit 50. Specifically, a high-frequency alternating current of from 10 kHz to 1 MHz is supplied to the coil 51, so that magnetic fluxes are alternatingly switched in a reciprocal direction in a loop of the coil 51. Thus, when the alternating magnetic field is formed, an eddy current is generated in the heat roller 41 and joule heat is generated, and the heat roller 41 is induction-heated. The fixing belt 43 is heated by heat from the thus-heated heat roller 41, the sheet P and the fixing belt 43 are contacted at the nip N, and thus, toner images on the sheet conveyed are heated and fused.

Next, cooling operation in the induction heating unit 50 will be described.

The cooling fan 57 operates when the fixing device is operated. When the cooling fan 57 rotates, the coil 51 is cooled by air. As described above as to the induction heating unit 50, because the aluminum cover 55 is disposed as a rectifying member, the distance between the coil retainer 54 to retain the coil 51 and the aluminum cover 55 disposed opposite the coil retainer 54 is shorter in the central portion (that is, the projecting portion 55*a*) than in the end portions. Accordingly, the speed of the airflow F near the linear portion 51*a* increases due to narrowing of the airflow path when the cooling fan 57 operates, and the cooling efficiency of the coil 51 in its entirety can be increased. In addition, because the front portion 55*b* of the aluminum cover 55 is opposed to the curved portion 51*b* of the side of the cooling fan 57, and the front portion 55*b* is slanted, the fluid resistance of the aluminum cover 55 relative to the airflow when the cooling fan operates is reduced and the airflow strikes on the coil 51 more easily. Thus, the cooling efficiency is further improved.

Figure 10:
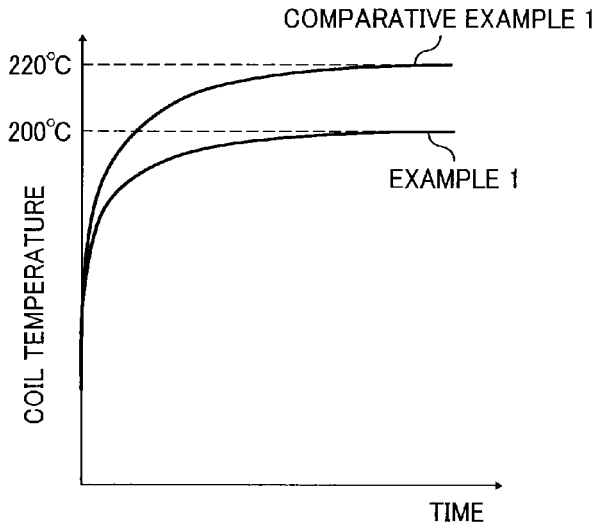
FIG. 10 is a graph illustrating a temperature of the coil when heated in a first embodiment and a first comparative example.

FIG. 10 is a graph illustrating a temperature of the coil when heated in the first embodiment and the first comparative example. In the comparative experiment using the structure as illustrated in FIG. 7 for the present embodiment and the structure as illustrated in FIG. 8 for the comparative example, the shape of the aluminum covers (55, 155) alone is different from each other whereas the other structures including the cooling fan are the same.

The experiment was conducted as follows. First, electrical power is supplied to the coil 51, and the temperature of the coil 51 when the surface temperature of the fixing belt 43 is heated up to the set temperature of 170 degrees C. is measured.

In the comparative example 1 of FIG. 8 using the straight aluminum cover 15 is used, the coil temperature increases up to 220 degrees C. By contrast, in the present embodiment 1, the highest temperature remains at 200 degrees C., thereby demonstrating that the temperature rise of the coil 51 in the present embodiment is suppressed by 20 degrees and that the cooling efficiency by the cooling fan 57 is improved compared to the comparative example 1.

Thus, in the present first embodiment, the fixing device having an improved cooling efficiency of the coil is realized by an uncomplicated structure and at a low cost without distorting from the outstanding structure of the fixing device. In addition, because the fixing device according to the first embodiment has excellent cooling efficiency, the low-power cooling fan can be used while ensuring that applicable safety standards are met. Additionally, the present embodiment is effective in the cost reduction, power saving, and noise reduction.

Figure 11:
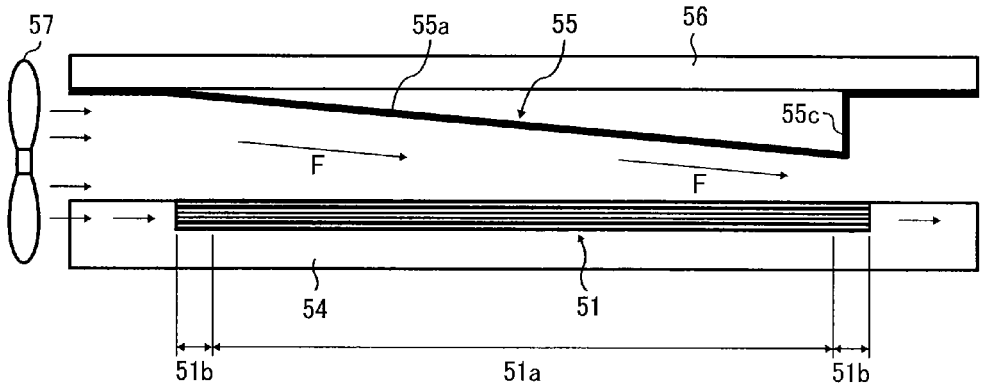
FIG. 11 illustrates a cross-sectional view of the induction heating unit seen from a longitudinal direction thereof according to a second embodiment.

FIG. 11 illustrates the induction heating unit according to a second embodiment. The induction heating unit according to the second embodiment is configured similarly to that in the first embodiment except that the shape of the aluminum cover 55 is different, and therefore redundant explanations with regard to the similar structure are omitted, and different parts only will be described.

In the induction heating unit according to the second embodiment as illustrated in FIG. 11, the projecting portion 55*a* as a portion expanding toward the coil is formed entirely as a slanted surface. In addition, the rear surface 55*c* downstream of the projecting portion 55*a* is formed as a right angle or a surface with a steep angle. On the other hand, the leading end of the projecting portion 55*a* reaches the ceiling portion, i.e., the resinous cover 56. Due to the projecting portion 55*a* formed entirely as a slanted surface, the cooled airflow F introduced by the cooling fan 57 is sent to the coil 51 via the slanted surface of the projecting portion 55*a*. As a result, because the cooled air tends to strike on the coil 51 over an entire range of the coil, the cooling efficiency can be improved. In addition, because the angle of the slanted surface of the projecting portion 55*a* is less than the front portion 55*b* according to the first embodiment, the fluid resistance of the aluminum cover 55 is reduced, thereby further improving the cooling efficiency. Further, the rear surface 55*c* may be slanted like the rear surface 55*c* as illustrated in FIG. 7 according to the first embodiment.

Figure 12:
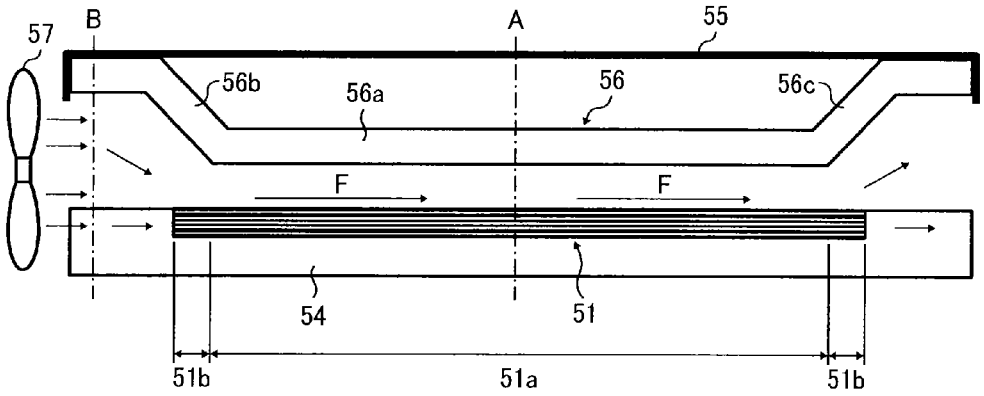
FIG. 12 illustrates a cross-sectional view of the induction heating unit seen from the longitudinal direction thereof according to a third embodiment.

FIG. 12 illustrates the induction heating unit according to a third embodiment. The induction heating unit according to the third embodiment is similar to that in the first embodiment except that the shape and function of the aluminum cover 55 and the resinous cover 56 are different, and therefore, the redundant description of the similar portion will be omitted.

In the induction heating unit according to the third embodiment as illustrated in FIG. 12, not the aluminum cover 55 but the resinous cover 56 serves as a rectifier to rectify a flow of cooled air from the cooling fan 57. Specifically, the aluminum cover 55 is disposed above and the resinous cover 56 is disposed beneath the aluminum cover 55. The resinous cover 56 is formed to include a projecting portion 56*a* so as to make the airflow path narrower. Differently from the first and second embodiments, the aluminum cover 55 does not include a projecting portion and is disposed parallel to the coil retainer 54.

The center portion of the resinous cover 56 in the longitudinal direction expands downward to form the projecting portion 56*a*, thereby narrowing the airflow path above the linear portion 51*a*. With this configuration, speed of the airflow F near the linear portion 51*a* during the operation of the cooling fan 57 is increased as the airflow path is narrowed, thereby improving the cooling efficiency of the coil 51 as a whole.

In addition, a front portion 56*b* upstream of a projecting portion 56*a* of the resinous cover 56 is slanted. Herein, the slanted surface means having a slant relative to the opposite coil retainer 54. The slanted surface also includes a smooth surface. Because the front portion 56*b* of the resinous cover 56 is a slanted surface, the fluid resistance of the resinous cover 56 relative to the airflow from the cooling fan 57 is reduced, thereby increasing the cooling efficiency.

In addition, a rear surface 56*c* downstream of the projecting portion 56*a* of the resinous cover 56 is formed as a slanted surface; however, similar to the rear surface 55*c* of the aluminum cover 55 as illustrated in FIG. 11 according to the second embodiment, the rear surface 56*c* may be formed as a right angle or a surface with a steep angle. Further, the rear surface 56*c* may be a slanted surface extending up to the opposite end in the longitudinal direction. As such, various forms are possible.

Figure 13:
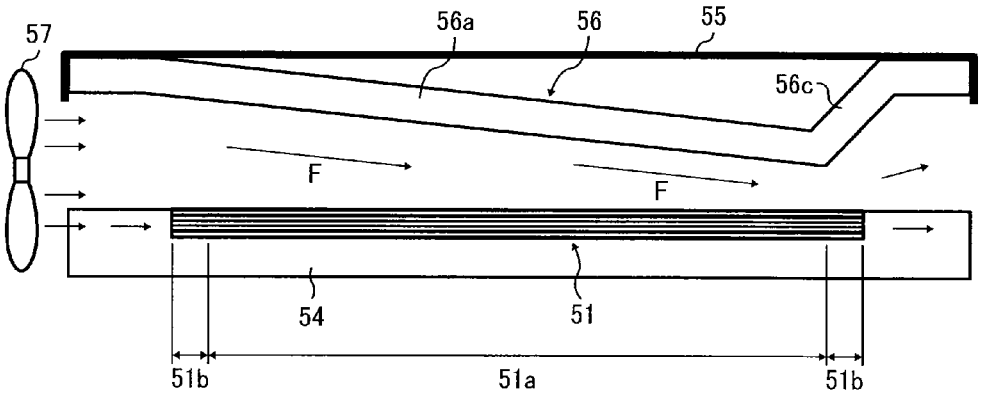
FIG. 13 illustrates a cross-sectional view of the induction heating unit seen from the longitudinal direction thereof according to a fourth embodiment.

FIG. 13 illustrates the induction heating unit according to a fourth embodiment. The induction heating unit according to the fourth embodiment is similar to that in the third embodiment except that the shape of the resinous cover 56 is different, and therefore, the redundant description of the similar portion will be omitted.

In the induction heating unit according to the fourth embodiment as illustrated in FIG. 13, the projecting portion 56*a* of the resinous cover 56 is formed entirely as a slanted surface. The function that the projecting portion 56*a* of the resinous cover 56 according to the fourth embodiment is the same as that performed by the projecting portion 55*a* of the aluminum cover 55 according to the second embodiment as illustrated in FIG. 11. Specifically, the cooled airflow F introduced by the cooling fan 57 is sent to the coil 51 via the slanted surface of the projecting portion 56*a* of the resinous cover 56. As a result, because the cooled air tends to strike on the coil 51 over an entire range of the coil, the cooling efficiency is improved. In addition, because the angle of the slanted surface of the coil-approaching surface 56*a* is less than the front portion 56*b* of the third embodiment, the fluid resistance of the resinous cover 56 becomes less, thereby further improving the cooling efficiency.

Next, a description will be given of a fifth embodiment, applied to a fixing device employing a heat roll method.

Figure 14:
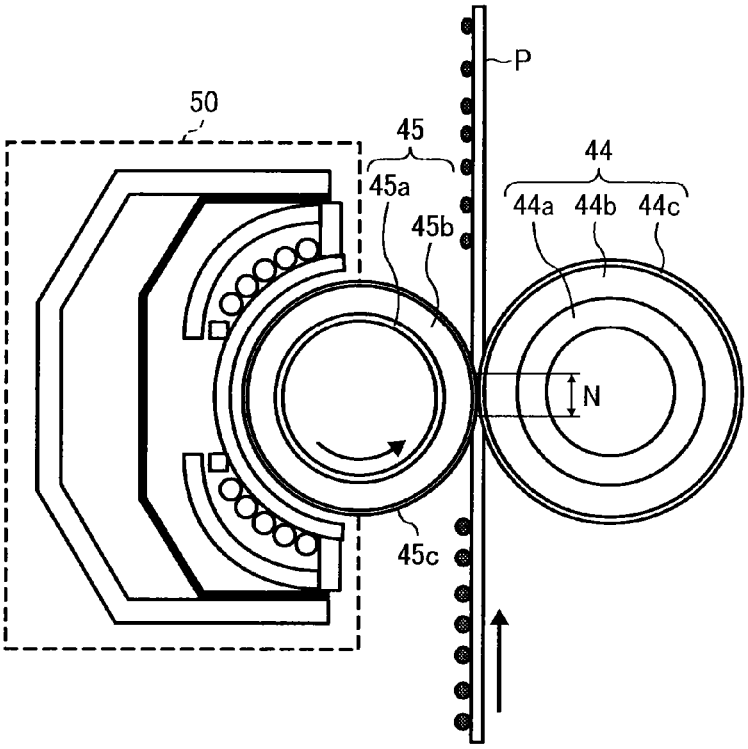
FIG. 14 illustrates a cross-sectional view of a fixing device employing a heat roll method according to a fifth embodiment.

FIG. 14 shows a fixing device including a fixing roller 45 serving as a fixing member and the induction heating unit 50 which heats the fixing roller 45. Except that the fixing roller 45 serves as the fixing device, the structure of the fixing device according to the fifth embodiment is the same as that of the fixing device as illustrated in FIG. 2. In the structure according to the fifth embodiment, the fixing roller 45 serves as the fixing member and also as the heat-generating member, because the fixing roller 45 is heated by the induction heating unit 50 and generates heat.

The structure and the operation of the induction heating unit 50 for use in the fifth embodiment are the same as those described in the first embodiment, and various configurations as described in the first to fourth embodiments may similarly be applied to the fifth embodiment, and therefore, the redundant description thereof will be omitted.

Specifically, the fixing roller 45 according to the fifth embodiment has an outside diameter of from 30 to 40 mm and includes an elastic layer 45*b*, a heat-generating layer 45*c*, and a release layer (not shown) laminated on a metal core 45*a*. The fixing roller 45 rotates in a counterclockwise direction in the figure, is heated by induction heating, and fuses the toner image carried on a recording sheet conveyed to the fixing nip portion.

As described above, the release layer, not shown, is formed as the topmost layer of the fixing roller 45. The release layer may be formed of fluorine resins such as: polytetrafluoroethylene (PTFE); tetrafluoroethylene-perfluoroalkyl vinylether copolymer (PFA); and tetrafluoroethylene-hexafluoropropylene copolymer (FEP), or mixture of these resins, or heat-resistant resins dispersed with above resins. The thickness of the release layer ranges from 5 to 50 μm, and more preferably from 10 to 30 μm. Such a range ensures both good toner releaseability from the fixing roller 45 and flexibility of the fixing roller 45.

The heat roller 45 includes the heat-generating layer 45*c* formed of Cu with a thickness of from 3 to 15 μm on the surface thereof, to thus improve the heat-generating effect. In this case, nickel coating is preferably applied on the surface of the Cu layer for preventing corrosion.

The elastic layer 45*b* of the fixing roller 45 can employ elastic members such as fluororubber, silicon rubber, and fluorosilicon rubber. Because the elastic layer 45*b* is employed in the fixing roller 45, bending of the fixing roller 45 is allowed and a width of the nip area can be increased. In addition, by lowering the stiffness of the fixing roller 45 than that of the pressure roller 44, sheet dischargeability and separability may be improved. In addition, by forming the elastic layer 45*b* with a sponge rubber, heat generated by the heat-generating layer 45*c* can be insulated, and the elastic layer and the release layer opposing to the surface of the fixing roller can be heated rapidly. Thus, the surface of the fixing roller is rapidly heated and reaches a temperature necessary for fixing and heat supply can be enough even though heat is absorbed by the recording medium. With such a configuration, an optimal nip area can be formed and heat-generating in the heat-generating layer 45*c* can be insulated, so that heat is prevented from being transmitted to an interior of the fixing roller 45. The elastic layer 45*b* according to the present embodiment employs foamed silicon rubber having an approximate thickness of 9 mm. As a result, heat of the heat-generating layer 45*c* disposed on the surface layer of the fixing roller 45 does not flow into the fixing roller 45 easily, and effective heating can be performed.

The metal core 45*a* of the fixing roller 45 has sufficient stiffness to bear a load given to the fixing roller 45 for forming a nip area. For that purpose, the metal core employs metals such as aluminum and iron. The metal core 45*a* may also employ non-magnetic, insulating materials such as ceramics so as not to affect the induction heating. The metal core 45*a* according to the fifth embodiment employs aluminum. According to the present structure, an external diameter of the core metal 45*a* is 22 mm and a thickness thereof is 2.0 mm. Stiffness to bear the load applied to the fixing roller 45 is required for the core metal 45*a* so that the thickness of the core metal 45*a* is 2.0 mm.

Figure 15:
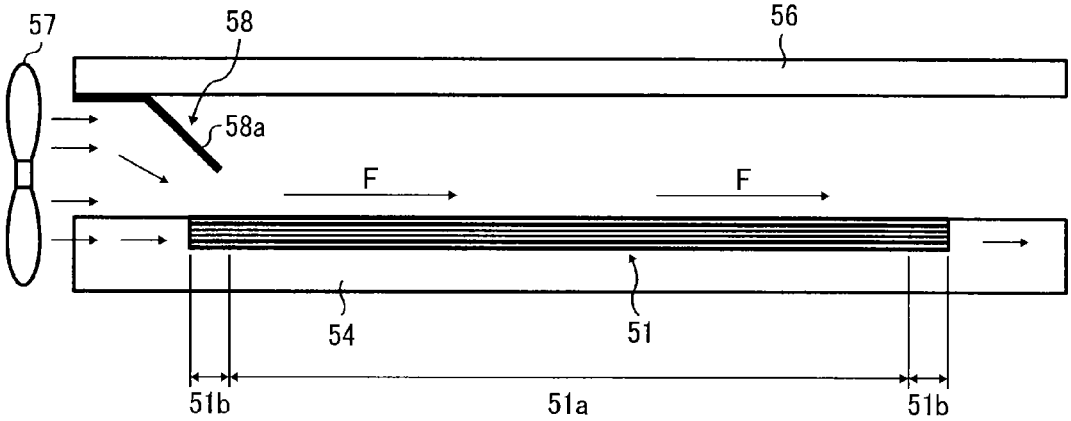
FIG. 15 is a cross-sectional view of the induction heating unit configured alternatively according to a sixth embodiment.

FIG. 15 illustrates an induction heating unit configured alternatively according to a sixth embodiment.

The induction heating unit 150 according to the sixth embodiment includes the excitation coil 51, the coil retainer 54, the resinous cover 56, the cooling fan 57, and an aluminum rectifying member 58. The aluminum rectifying member 58 is not opposed to the linear portion 51*a* of the excitation coil, but is disposed at the upstream end of the induction heating unit 150 near the side of the cooling fan 57.

The aluminum rectifying member 58 includes a slanted surface 58*a* protruding to a space below the resinous cover 56. The aluminum rectifying member 58 is not opposed to the linear portion 51*a* of the excitation coil, but includes a slanted surface 58*a* extending to the side of the coil from the end of the cooling fan 57, thereby narrowing the airflow path. As a result, because the speed of the airflow F flowing through the coil linear portion 51*a* increases, the coil cooling efficiency is improved.

As described above, the fixing device according to the first to sixth embodiments includes a structure in which a distance between the coil retainer and the cover member is narrowed in the center portion covering the predetermined area in the longitudinal direction of the excitation coil and in the fixing member rotary axis direction, or alternatively, includes a rectifying member extending from the cover member to the coil retainer and narrowing the airflow path formed between the cover member and the coil retainer. As a result, the speed of the cooled air passing through the coil disposed position increases, thereby improving cooling efficiency of the coil. Accordingly, the rotation number of the cooling fan can be reduced and the compact-size cooling fan can be realized, so that the cost and the energy consumption can be reduced and the noise can be reduced.

In addition, the range where the distance between the coil retainer and the cover member is shortened is set to at least an area corresponding to the linear portion of the excitation coil, so that the linear portion of the coil being a greater heat-generating area can be effectively cooled.

In addition, because the distance to the coil retainer is shortened by the projecting portion disposed on the cover member, shortening of the airflow path can be realized with an uncomplicated structure.

Further, because the portion near the cooled air inlet of the projecting portion is formed as a slanted surface, the fluid resistance of an inside of the induction heating unit can be reduced, thereby further improving the coil cooling efficiency.

Furthermore, because the slanted surface is disposed facing the curved portion of the excitation coil, the cooling air from a ventilation means can effectively be introduced to the coil surface.

Further, because the projecting portion is entirely formed as a slanted surface, the fluid resistance of an inside of the induction heating unit can be further reduced, thereby further improving the coil cooling efficiency.

In addition, because the shield member to protect against electromagnetic radiation is made a cover member, use of the shield member may improve the cooling efficiency of the coil.

In addition, because the housing of the induction heating unit is made a cover member, use of the unit housing may improve the cooling efficiency of the coil.

Furthermore, because the rectifying member protruding from the cover member is disposed near an end of the cooled air inlet, the cooled air from the ventilation means can be effectively introduced to the coil surface.

Further, because the surface at the cooled air inlet of the rectifying member is formed as a slanted surface, the fluid resistance can be prevented from increasing.

Next, a seventh embodiment according to the present invention will be described with reference to FIGS. 16 through 30. A structure and operation of the image forming apparatus as a whole is the same as those described referring to FIG. 1 and therefore, the explanation thereof will be omitted.

Hereinafter, operation of the thus-configured fixing device will be described.

Figure 16:
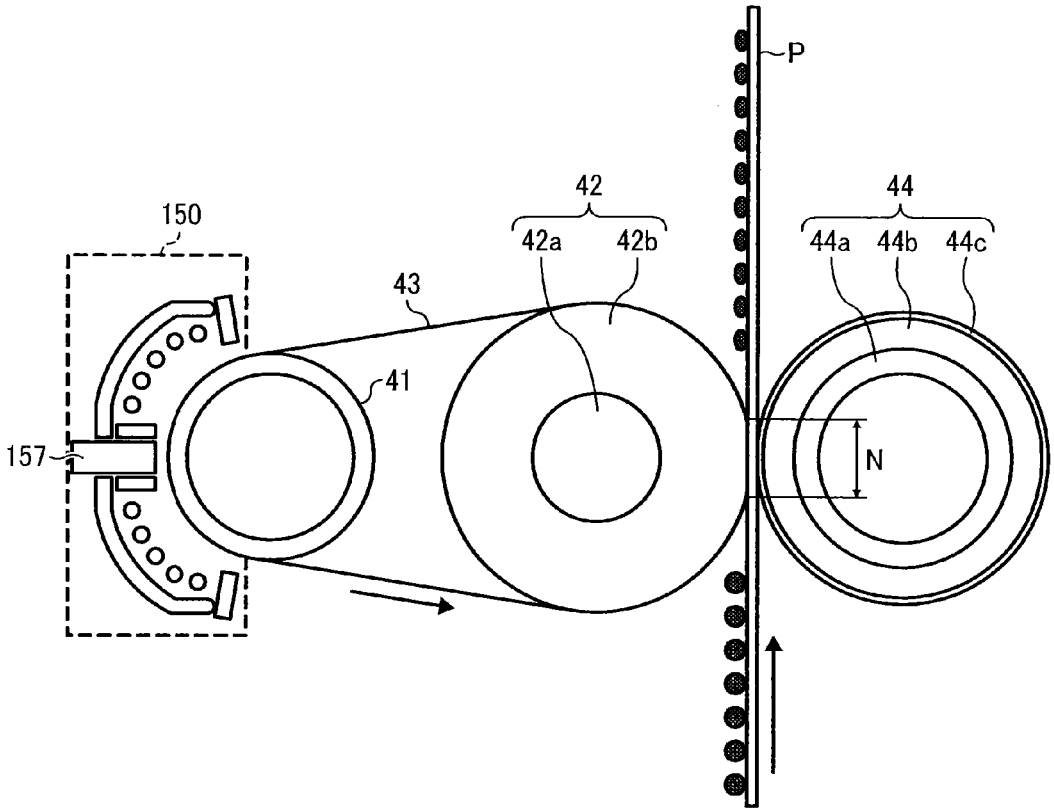
FIG. 16 illustrates a cross-sectional view of the fixing device according to a seventh embodiment.

The fixing belt 43 rotates in the direction indicated by an arrow in FIG. 16, i.e., in the counterclockwise direction. The heat roller 41 is heated by an induction heating unit 150. Specifically, because a high-frequency alternating current of 10 kHz to 1 MHz is supplied to an excitation coil 151, magnetic fluxes are formed in a loop of the excitation coil 151 so as to be alternatingly switched in a reciprocal direction. Thus, when the alternating magnetic field is formed, an eddy current is generated in the heat roller 41 and joule heat is generated, and the heat roller 41 is induction-heated. The fixing belt 43 is heated by heat from the thus-heated heat roller 41, the sheet P conveyed and the fixing belt 43 are contacted at the nip N, and thus, toner images on the sheet is heated and fused.

If the induction heating efficiency is improved, a surface temperature of the fixing belt 43 is rapidly increased, and the heat rise property becomes very optimal. Heat rise property indicates a rise time to reach a temperature necessary for the fixing belt 43 to fix the toner. A shorter rise time is regarded as optimal.

In addition, if the heating efficiency is improved, power necessary to print the sheet is also reduced, thereby providing a low-energy-consumption image forming apparatus.

When the heat roller is being heated, because the high-frequency alternating current is supplied to the excitation coil 151, the coil itself is heated by the joule heat and the temperature of the excitation coil 151 increases. In addition, in the seventh embodiment, the excitation coil 151 is disposed as close to the heat roller 41 as possible. As a result, the temperature of the excitation coil 151 increases due to the radiation heat from the heat roller 41.

Herein, if the temperature of the excitation coil 151 increases, the electrical resistance of the excitation coil 151 increases due to the relation between the electrical resistance of the metal and the temperature coefficient, and the heat-generating efficiency decreases. Accordingly, when a printing operation of the electrophotographic apparatus continues from an initial operation, the temperature of the excitation coil increases, and by contrast, the heat-generating efficiency gradually is reduced. To prevent this decrease in efficiency and any accident such as breaking of the excitation coil, a cooling fan is used to cool the excitation coil by airflow. In the present embodiment, as described later below, a cooling fan 161 is provided to send cooled air into the induction heating unit 150 to thereby cool the excitation coil 151. In the present embodiment, the cooling efficiency of the excitation coil by the cooled airflow is improved, which will be described below.

Figure 17:
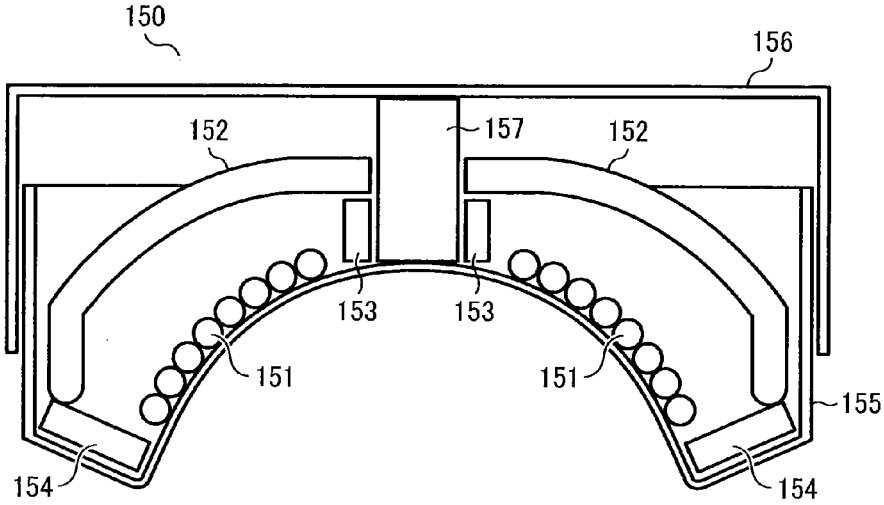
FIG. 17 illustrates a cross-sectional view of an induction heating unit according to the seventh embodiment.

FIG. 17 illustrates a structure of an induction heating unit 150. FIG. 17 shows a cross-sectional view of the induction heating unit 150 around the end in the longitudinal direction thereof, seen from an axial direction of the heat roller 41. Specifically, the cross-section in FIG. 17 is taken along line A-A in FIG. 20, which will be described later.

As illustrated in FIG. 17, the induction heating unit 150 according to the present embodiment includes excitation coil 151, arch cores 152, center cores 153, side cores 154, a case 155, a cover 156, and a rectifying member 157. The case 155 serves also as a coil retainer on which the excitation coil 151 are disposed.

Core members including the arch cores 152, the center cores 153, and the side cores 154, form a magnetic path in which the magnetic flux generated by the excitation coil 151 is focused to the heat generating member such as the heat roller 41.

Multiple arch cores 152 are disposed at appropriate intervals in the roller longitudinal direction (see FIG. 19), so that the temperature distribution in the longitudinal direction of the heat roller 41 becomes uniform. Because the structure and material of the magnetic cores are similar to those in the first embodiment, redundant descriptions are omitted.

The case 155 is covered by the cover 156 to prevent contact with parts inside the induction heating unit 150 mistakenly. The cover 156 should be heat-resistant and is preferably formed with highly heat-resistant resins such as PET or crystal liquid polymers, if resins are employed. In the seventh embodiment, the cover 156 employs an aluminum material which also serves as electromagnetic shielding to avoid leakage from the magnetic field.

Figure 18:
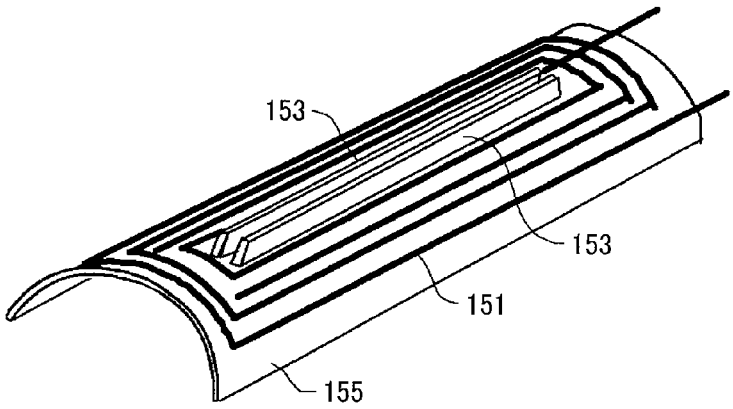
FIG. 18 schematically illustrates a structure of an excitation coil according to the seventh embodiment.

Referring now to FIG. 18, the structure of the excitation coil 151 will be described in detail.

As described above, the excitation coil is formed such that the surface-insulated litz wire is wound around multiple times in the rectangle shape extending in the axial direction of the heat roller 41 as illustrated in FIG. 18. In addition, the thus-wound excitation coil 151 is curved in the arch shape along an outer circumference of the heat roller 41 seen from the axial direction of the heat roller 41. Then, in the present embodiment, center cores 153 are disposed, at a portion corresponding to the interior of the rectangle shape, along the axial direction of the heat roller 41.

Figure 19:
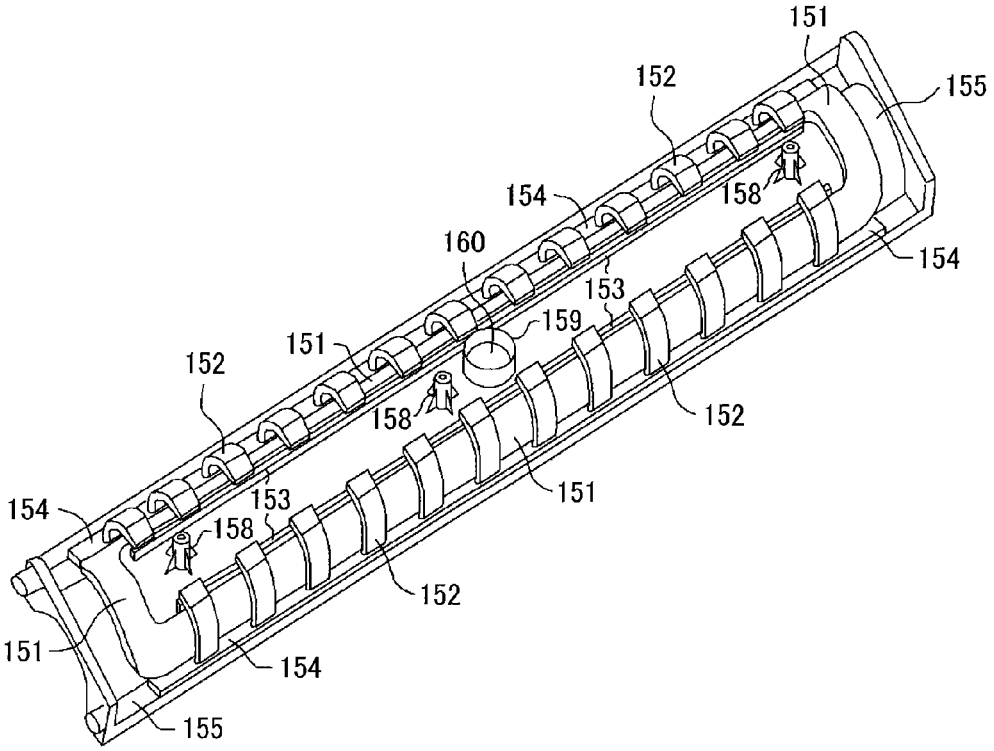
FIG. 19 is an oblique view illustrating a specific configuration of a portion at which the excitation coil is disposed according to the seventh embodiment.

FIG. 18 schematically illustrates the excitation coil 151 wound in the rectangle shape and FIG. 19 obliquely illustrates an embodied example.

As illustrated in FIG. 19, the rectangle excitation coil 151 with round corners is attached on an upper surface of the case 155 which also serves as a coil retainer. The case 155 is exposed at an internal side of the excitation coil 151. Further, as illustrated in FIG. 19, two center cores 153 are disposed on the internal side of the excitation coil 151 along the axial direction of the heat roller 41. Furthermore, the side cores 154 are disposed at an external side of the excitation coil 151 along two longitudinal sides of the rectangle shape extending in the axial direction of the heat roller 41. Multiple arch cores 152 are disposed at intervals each other so as to cover the excitation coil 151 from above.

In the present embodiment, the cover 156 is fixed with screws to the case 155 by three bosses 158 positioned at an internal side relative to the excitation coil 151, that is, at both ends and a center position. The bosses 158 are integrally formed on the case 155. In addition, a circular opening 160 is disposed at a substantially center of the internal side in the longitudinal direction of the excitation coil 151. A non-contact type temperature sensor, not shown, to measure a temperature of the heat roller 41 is disposed at the round opening 160. A cylindrical protection wall 159 is disposed around the circumference of the opening 160. The protection wall 159 is integrally formed on the case 155.

Figure 20:
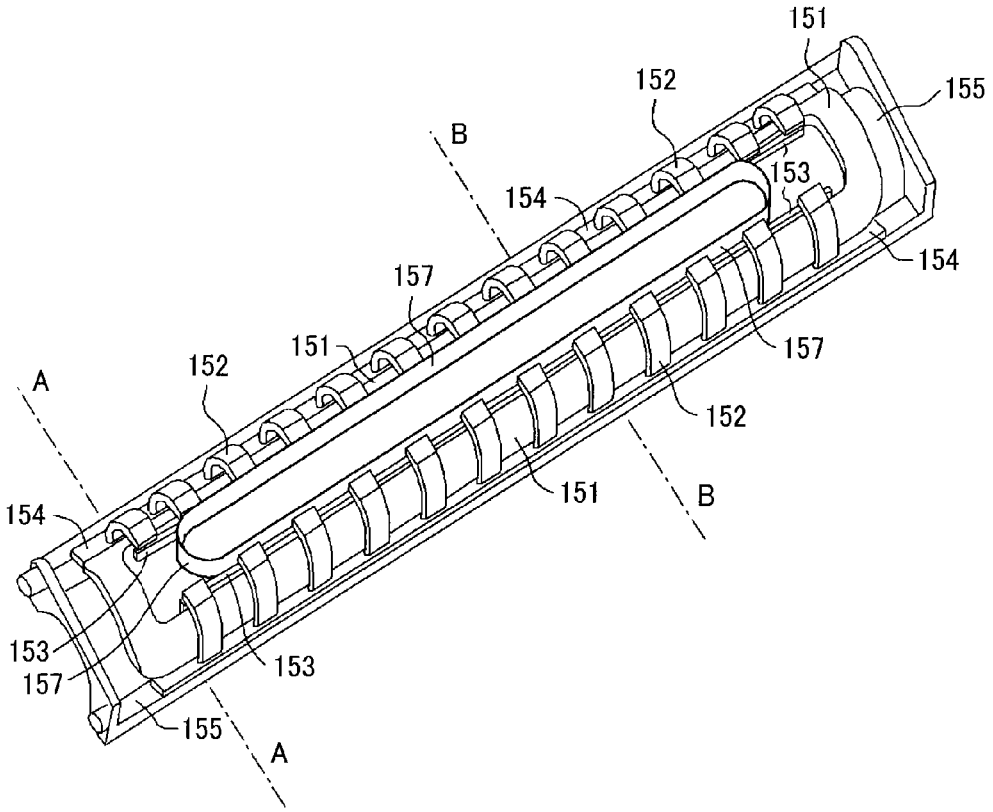
FIG. 20 is an oblique view illustrating a rectifying member disposed on the inner side of the excitation coil according to the seventh embodiment.

Further, as illustrated in FIG. 20, the rectifying member 157 is disposed inside the excitation coil 151 along the longitudinal direction of the heat roller 41. In the present embodiment, the rectifying member 157 is integrally formed with the case 155; however, the rectifying member 157 may be formed separately from the case 155. The rectifying member 157 has a shape like a wall and has a rectangle shape with round both ends in the longitudinal direction if seen from above. In FIGS. 18 and 19, the rectifying member 157 is not illustrated unintentionally. In FIG. 20, the bosses 158 and the protection wall 159 are not illustrated. In addition, the bosses 158 disposed at both ends can be integrally formed with the rectifying member 157. Further, in the present seventh embodiment, the central boss 158 and the protection wall 159 are disposed inside the rectifying member 157.

Figure 21:
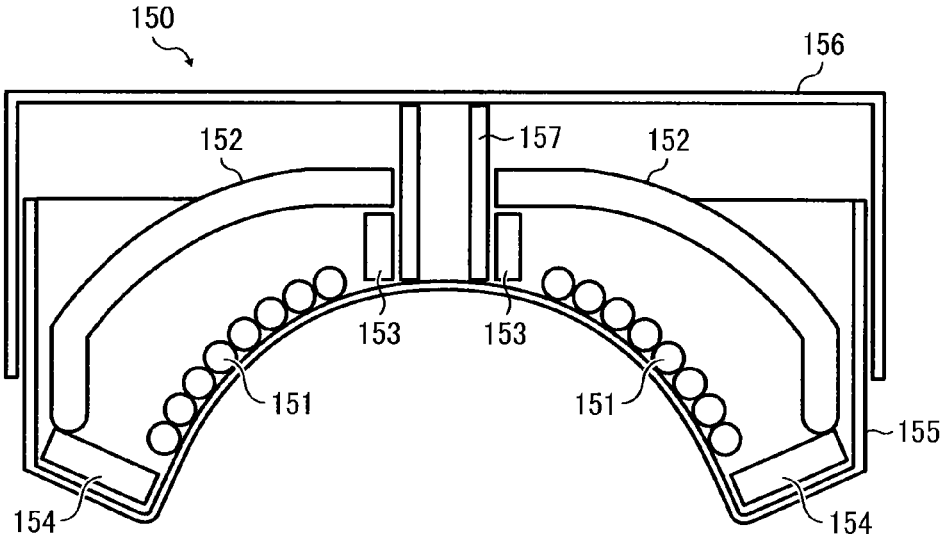
FIG. 21 illustrates a cross-sectional view of the induction heating unit at a center portion in the longitudinal direction thereof.

As described above, the rectifying member 157 is disposed in the wall shape and, in FIG. 17 that is a cross-sectional view of the induction heating unit 150 taken along the Line A-A near the end in the longitudinal direction of the induction heating unit 150 in FIG. 20, an external end surface of the rectifying member 157 is illustrated as a rectangle. In FIG. 21 that is a cross-sectional view along the B-B line in FIG. 20, the rectifying member 157 is illustrated as two wall members.

As is known from FIG. 17, the rectifying member 157 is so disposed as to divide into two (laterally in FIG. 17) a space formed by the excitation coil mounting surface of the case 155 and an interior wall of the cover 156 opposed to the coil mounting surface. In the present embodiment, the rectifying member 157 is integrally formed with the case 155 so as to extend from an upper surface of the case 155 and there is no gap between the rectifying member 157 and the case 155. Further, when the cover 156 is fixed to the case 155 with screws, the cover 156 is contacted an upper edge of the rectifying member 157, so that there is no gap between the rectifying member 157 and the cover 156.

As a result, because inside the induction heating unit 150 the rectifying member 157 is so disposed as to divide into two the space in which the excitation coil 151 are disposed, an airflow when cooled air is sent from one end in the longitudinal direction of the induction heating unit 150 is similarly divided into two by the rectifying member 157.

The rectifying member 157 is preferably formed with highly heat-resistant resins such as PET or crystal liquid polymers. In the present embodiment, the liquid crystal polymer that is the same material used for the case 155 is used for the rectifying member 157.

As will be described later, the rectifying member is used to rectify an airflow inside the induction heating unit to improve cooling efficiency, it can be formed with any thermally conductive materials, so that heat discharge from the excitation coil can be promoted during the operation. To reduce the fluid resistance, a surface of the rectifying member 157 is preferably smoothed. Accordingly, preferred materials for the rectifying member 157 include, other than materials cites herein, metals such as aluminum, copper, and iron, and resins having a smoothed surface may be used.

Figure 22:
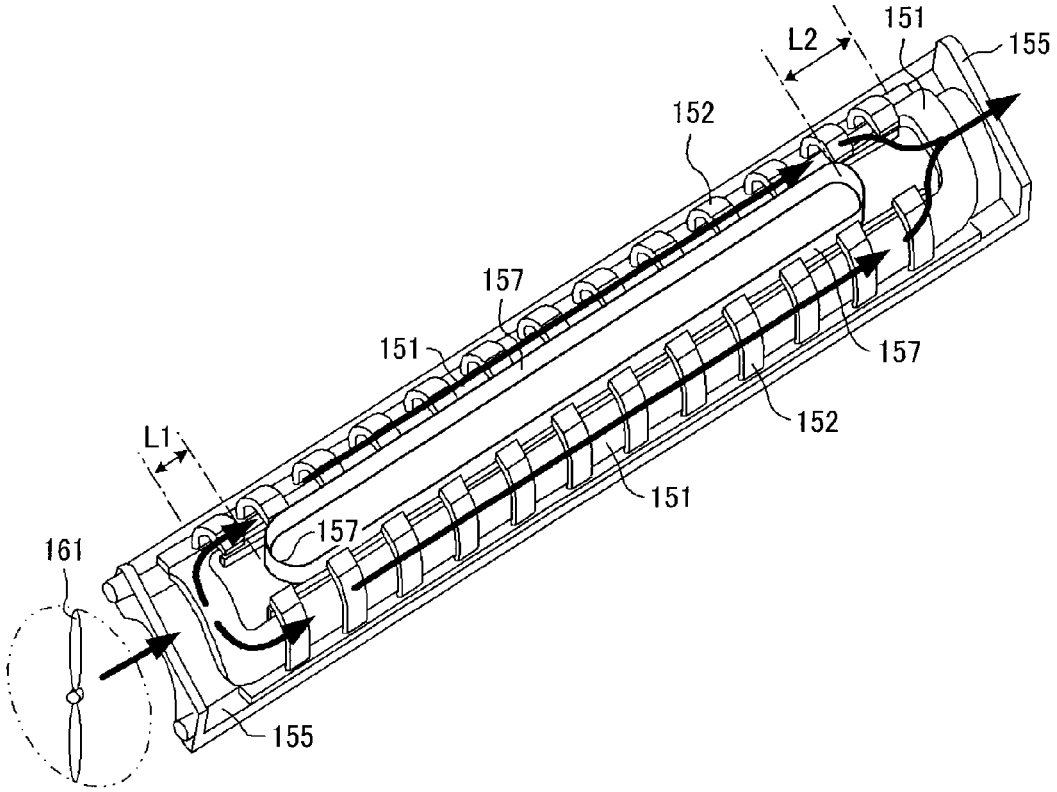
FIG. 22 schematically illustrates a function of the rectifying member according to the seventh embodiment.

FIG. 22 schematically illustrates a function of the rectifying member 157 according to the seventh embodiment.

In FIG. 22, a cooling fan 161 is disposed at one end in the longitudinal direction of the induction heating unit 150 (the cover 156 is omitted in the same figure). The cooling fan 161 sends cooled air into the induction heating unit. In the present embodiment, the cooling fan 161 is disposed at one lateral side of the induction heating unit 150. Alternatively, an airflow path such as a duct is formed to connect the cooling fan 161 and the induction heating unit 150 and the induction heating unit 150 is air-cooled via the airflow path.

As illustrated in FIG. 22 with a bold arrow, the cooled air sent by the cooling fan 161 into the induction heating unit 150 first cools a curved portion as a shorter side of the excitation coil 151, that is, a curved portion connecting two linear portions of the excitation coil 151, and then, the thus-sent cooled air strikes on the rectifying member 157 and is branched into two currents. The two currents flow along the longer sides of the excitation coil 151. The air current flows along the outer side of the rectifying member 157 as illustrated in the cross-sectional view in FIG. 21 and the cooled air flows along the excitation coil 151. In this case, the air does not flow a portion between two upright members of the rectifying member 157, that is, an inner portion of the excitation coil 151 where no coil exists.

Figure 23:
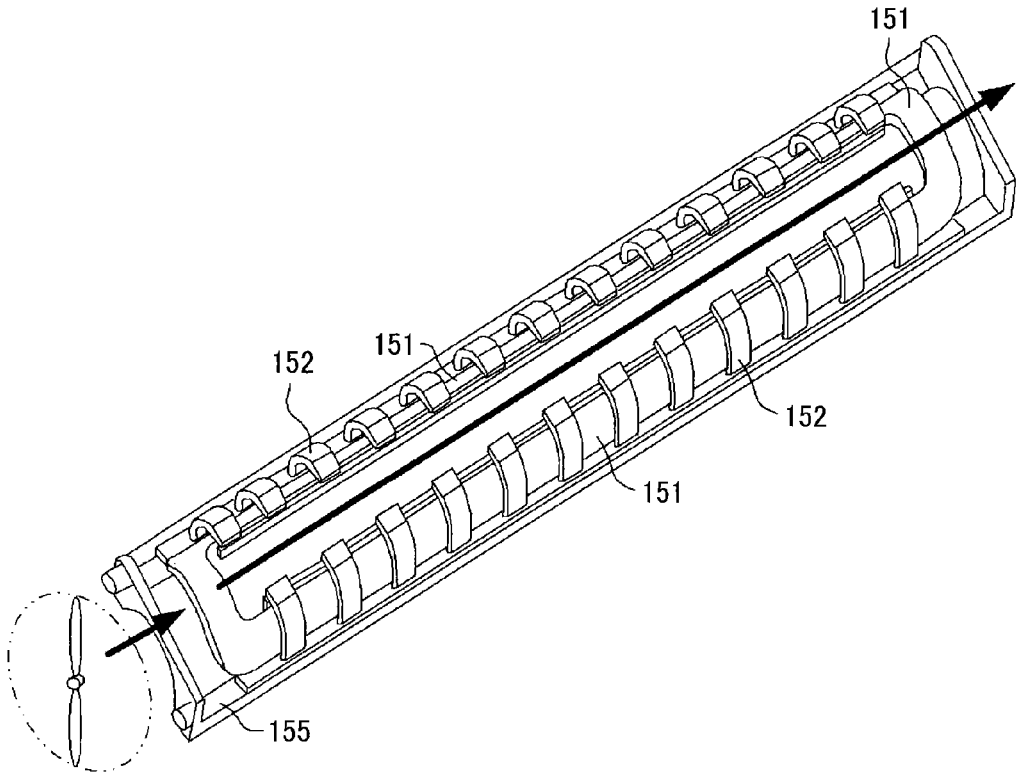
FIG. 23 BACKGROUND ART
FIG. 23 schematically illustrates a conventional structure of the induction heating unit without a rectifying member.

FIG. 23 schematically illustrates the airflow of the induction heating unit according to a conventional structure without a rectifying member. In the conventional example, the cooled air sent from the cooling fan into the unit flows linearly as is and passes through the unit. The air flows along the inner side of the excitation coil 151 where no coil exists. Much air flows along the inner side of the excitation coil 151 because there are few obstacles such as an arch coil 152 to disturb the airflow.

However, the excitation coil needs to be cooled most in the induction heating unit, safety is secured by reducing a temperature of the excitation coil, and the heating efficiency can be improved by decreasing the coil resistance. The rectifying member 157 according to the present invention can focus the airflow around the excitation coil 151 and increase the speed of the airflow, thereby improving the cooling efficiency of the excitation coil 151.

By contrast, because the conventional induction heating unit causes the cooled air flowing inside the unit to evenly flow into both the coil-equipped portion and the center portion where no coil exists, the cooling efficiency is inferior to that in the present embodiment.

As the amount of airflow increases, the cooling efficiency rises. This is because the heat conduction coefficient between the excitation coil 151 and the airflow increases, and the discharged heat amount to air increases.

Herein, as illustrated in FIG. 22, a distance L1 between the rectifying member 157 and the curved portion of the excitation coil 151 at upstream of the cooled air path nearer to the cooling fan 161 is preferably set to shorter than a distance L2 at an opposite side downstream in the cooled air path. More specifically, as illustrated in FIG. 22, the distance between the rectifying member 157 and the excitation coil 151 is defined as follows: L1<L2, wherein L1 shows a distance in the upstream of the cooled air path and L2 shows a distance in the downstream of the cooled air path. The above inequality stands because, upstream, the end portion of the rectifying member 157 is set closer to the curved portion of the excitation coil 151 and sends the airflow divided by the rectifying member 157 into two along the coil curved portion, thereby effectively cooling the coil curved portion.

On the other hand, because much distance is required for the air currents divided by the rectifying member 157 to get together in the downstream of the cooled air path, if the end portion of the rectifying member 157 approaches the coil curved portion, cooling efficiency is degraded. Therefore, by making the distance L2 greater than L1, the coil curved portion can be effectively cooled by the air joined-together in the downstream of the rectifying member 157.

In a comparative experiment, the seventh embodiment has been compared to the conventional one as described above (see FIG. 10). In the comparative experiment, the seventh embodiment, which has been described referring to FIGS. 16 to 22, and a third comparative example described referring to FIG. 23 have been used. The difference between the two resides in the presence or absence of the rectifying member 157; otherwise, the remaining structure is the same. The experiment was conducted as follows.

First, electrical power is supplied to the coil 151, and, after the surface temperature of the fixing belt 43 is heated up to the set temperature of 170 degrees C., the set temperature is held and the temperature of the coil 151 is measured when printing has been done continuously. The temperature of the excitation coil 151 was measured at a position in which the temperature becomes highest at an outlet of the airflow. In the comparative example, the temperature of the excitation coil temperature has increased up to 220 degrees C. By contrast, in the present seventh embodiment, the highest temperature remains at 200 degrees C. As a result, it can be seen that the temperature rise of the coil 151 in the present seventh embodiment is suppressed by 20 degrees and that the cooling efficiency is improved compared to the comparative example 3.

That is to say, the present invention provides an optimal fixing device capable of effectively cooling the coil with uncomplicated structure. With such a structure, the low-power cooling fan can be used while conforming to applicable safety standards, and a low-cost, energy-saving, and low-noise induction heating unit can therefore be expected. In addition, if the heating efficiency is improved by cooling the excitation coil, power necessary to print the sheet is also reduced.

In addition, the rectifying member is preferably disposed inside or at an internal circumference of the excitation coil. If the rectifying member is disposed at an external circumference of the excitation coil, the curved portion at an end of the coil cannot be cooled effectively. A description is given below of the reason thereof.

Figure 24A:
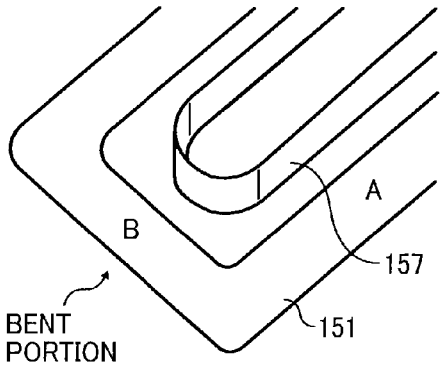
FIGS. 24A and 24B schematically illustrate a bent portion of the excitation coil according to a present embodiment and a comparative example.
Figure 24B:
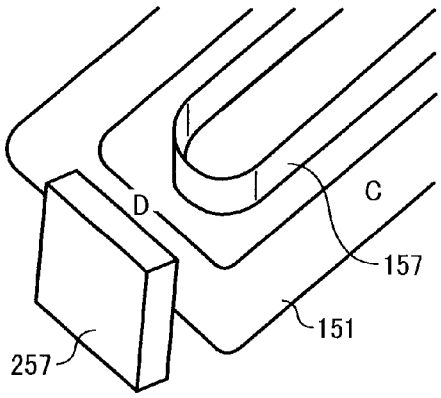
Figure 25:
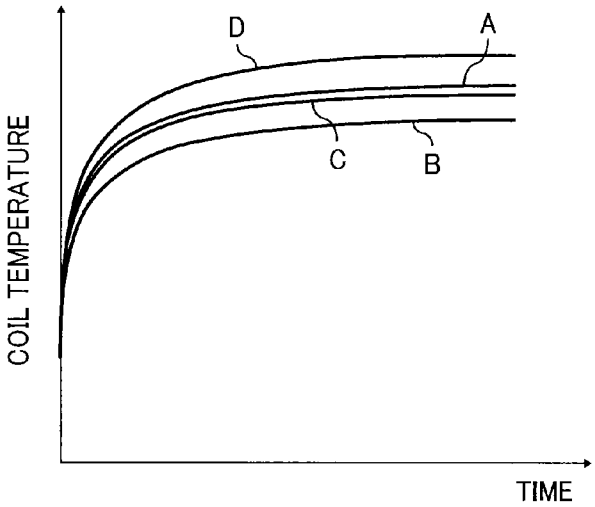
FIG. 25 is a graph illustrating a result of an experiment comparing the present embodiment and the comparative example.

FIG. 24A illustrates a coil curved portion in the seventh embodiment (Example 7). FIG. 24B illustrates a comparative example 4 including another rectifying member 257 disposed outside the excitation coil 151. Marks A to D shown in FIGS. 24A and 24B correspond to positions of the excitation coil 151. FIG. 25 is a graph to show temperature curves measured at corresponding positions A to D when the induction heating unit is heated.

By disposing the rectifying member 257 outside the excitation coil 151, the airflow is earlier sent to a linear portion of the excitation coil 151, so that the temperature at C is higher than that at A; however, because the airflow is disturbed in the downstream path, the temperature at D at the end of the curved portion is not cooled effectively.

Even a partial heat rise may cause breakage of the excitation coil, and therefore, the rectifying member is preferably disposed inside the excitation coil to cool the excitation coil entirely.

In the seventh embodiment, the end surface of the rectifying member 157 opposed to the curved portion of the coil end is curved protruding upstream. This is to reduce the fluid resistance of the rectifying member 157 relative to the airflow. When the fluid resistance is reduced, the speed of the airflow increases and the cooling efficiency is further improved.

Figure 26:
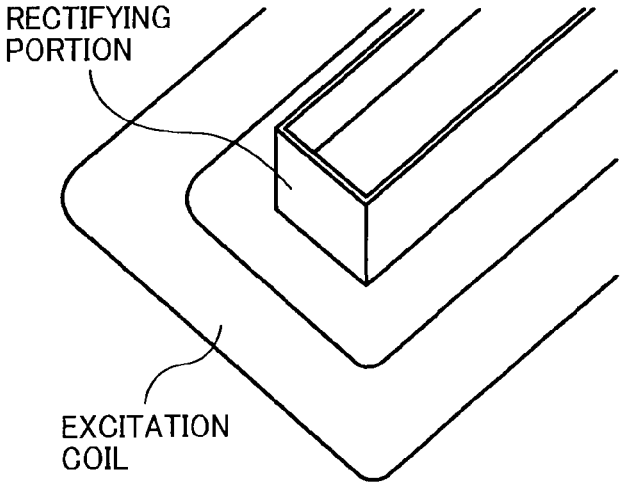
FIG. 26 schematically illustrates a conventional structure of the induction heating unit with a rectifying member.
Figure 27:
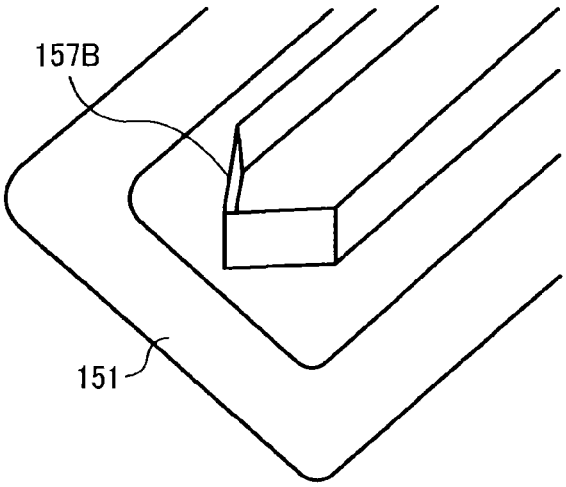
FIG. 27 illustrates a rectifying member having a square leading end protruding toward an upstream side.

FIG. 26 shows an example of the rectifying member having a wall confronting the airflow, which is not preferable due to an increase of the fluid resistance. By contrast, as illustrated in FIG. 27, the rectifying member 157B having a triangular leading end upstream is preferable because it reduces fluid resistance. The fluid resistance decreases due to the leading end having an acute angle.

In addition, because the rectifying member 157 is integrally formed with the case 155, this integrity serves as a rib to increase stiffness of the case 155.

FIGS. 28A to 29B schematically illustrate an intended design of the induction heating unit in the background art and an actually molded product in the present embodiment, respectively. FIGS. 28A to 29B each illustrate an induction heating unit seen from the longitudinal direction of the unit.

Figure 28A:
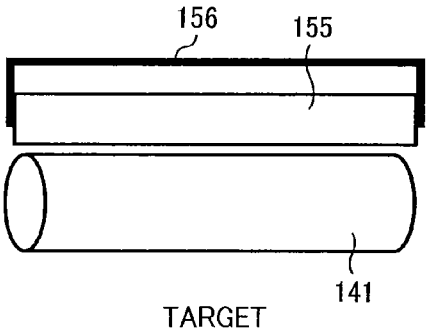
FIG. 28A BACKGROUND ART
FIGS. 28A and 28B schematically illustrate a target in designing and an actually molded product in a background art.
Figure 28B:
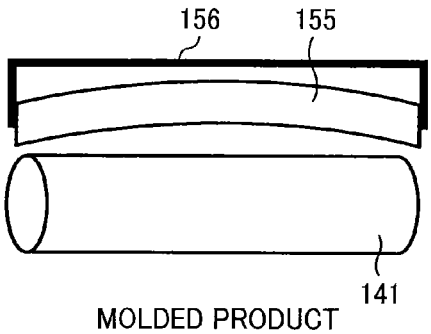
FIG. 28B BACKGROUND ART

As seen from FIG. 28B, in the conventional method without using the rectifying member serving also as the rib, the molded product may be curved despite the intended design. When the case 155 is curved, the distance between the excitation coil and the heat roller 41 is away, thereby decreasing the heat-generating efficiency. When the case 155 is made thicker, the distance between the excitation coil and the heat roller 41 is made greater, resulting in reduction of the heat-generating efficiency.

Figure 29A:
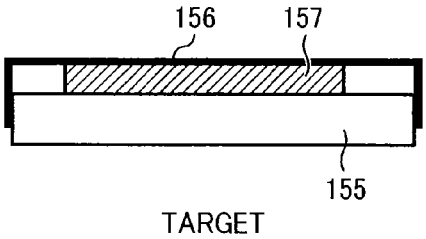
FIGS. 29A and 29B schematically illustrate a target in designing and an actually molded product in the present embodiment.
Figure 29B:
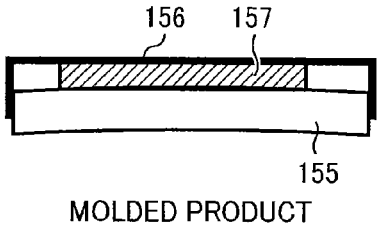

On the other hand, in the embodiment as illustrated in FIGS. 29A and 29B, the rectifying member 157 disposed at an inner circumference of the excitation coil, is used integrally with the case 155. As a result, there is provided a rib at a center in the longitudinal direction of the case 155, thereby strengthening the case 155. Provision of the rib may increase stiffness, thereby reducing the curve. Further, the other portion of the case can be formed with a thinner wall. Reducing the curve and thinning the wall allows the induction heating unit to be closer to the heat roller 41, and heat-generating efficiency of the induction heating can be improved.

The present invention is not limited to the fixing device employing a fixing belt method, but can be applied to the fixing device employing a heat roll method. Hereinafter, a description will be given of an eighth embodiment applied to the fixing device employing the heat roll method.

Figure 30:
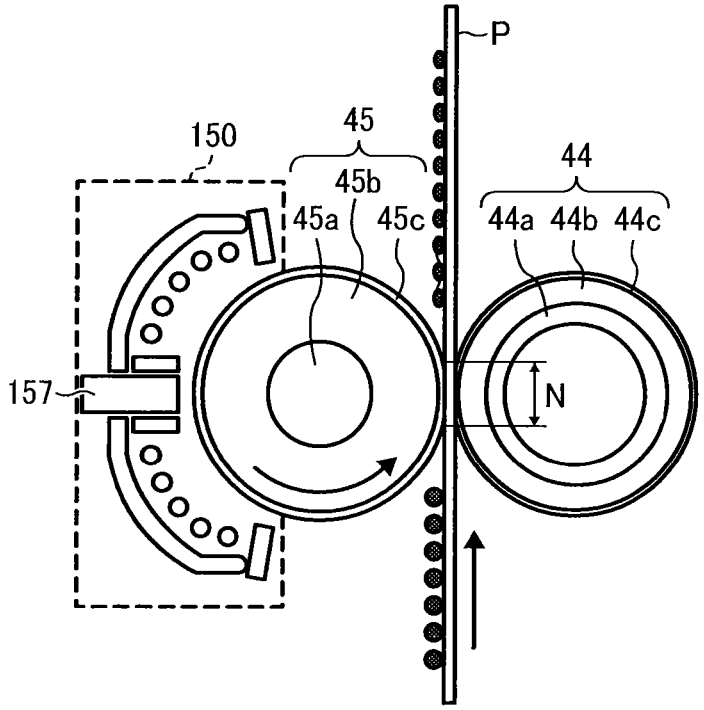
FIG. 30 illustrates an eighth embodiment in which the seventh embodiment is applied to a fixing device employing a heat roll.

FIG. 30 shows a fixing device including a fixing roller 45 serving as a fixing member and the induction heating unit 50 to heat the fixing roller 45 according to the eighth embodiment. Except that the fixing roller 45 is used as the fixing member, the fixing device according to the eighth embodiment is similar to that in the seventh embodiment as illustrated in FIG. 16. In the structure according to the eighth embodiment, the fixing roller 45 serves as the fixing member and also as the heat-generating member, because the fixing roller 45 is heated by the induction heating unit 150 and generates heat.

The structure and operation of the induction heating unit 150 used in the eighth embodiment are the same as those described in the seventh embodiment including the rectifying member 157, and therefore, the redundant description thereof will be omitted. Furthermore, because the fixing roller 45 in the eighth embodiment is the same as that in the seventh embodiment, the redundant description thereof is omitted.

The fixing device as described in the above seventh and eighth embodiments includes a rectifying member, to divide the air flowing into the induction heating unit 150 into two currents, disposed inside the induction heating unit 150 between the excitation coil-mounted surface and the opposite surface thereof and at an inner side of the excitation coil, so that the speed of the airflow of the cooled air near the excitation coil is increased and the cooling efficiency can be improved without increasing the power of the cooling fan, so that the induction heating unit is energy-saving. As the coil temperature is further reduced, the heating efficiency of the excitation coil is improved more. Thus, a low-cost and highly heating efficient fixing device can be provided. In addition, because a high cooling efficiency can be obtained with an uncomplicated configuration of providing the rectifying member, the cost rise can be minimized.

Further, the rectifying member is disposed along the longitudinal direction of the induction heating unit so as to send the airflow divided in two along the linear, longitudinal direction of the excitation coil, thereby being capable of efficiently cooling the longer side portion of the excitation coil having a greater thermal energy.

The end surface upstream in the airflow path of the rectifying member can be a curved or sharply-angled shape, the fluid resistance of the rectifying member is reduced and the cooling efficiency can be further improved.

The distance between the rectifying member and the curved surface of the excitation coil in the upstream of the airflow path is shorter than that in the downstream in the airflow path. Therefore, the airflow divided into two by the rectifying member is sent along the coil curved portion, thereby effectively cooling the coil curved portion. In the downstream of the airflow path, the airflow joined together in the downstream of the rectifying member is sent along the coil curved portion, thereby effectively cooling the coil curved portion.

When the rectifying member is formed of any materials with excellent thermal conductivity, heat discharge from the excitation coil during the operation can be promoted.

Further, because the rectifying member is used also as a reinforcement rib, the strength of the case retaining the excitation coil can be enforced, deformation of the case can be suppressed and the thickness of the case can be smaller.

Heretofore, the present invention has been described with reference to drawings, but is not limited to the aforementioned embodiments alone, and can be varied in the scope. Further, a size and shape of the rectifying member can be varied within the scope. For example, the shapely-angled shape of the rectifying member in FIG. 27 is described such that the leading end is closed and the airflow is divided into two. However, as long as the structure to send the air substantially effectively is realized, the leading end of the rectifying member can be formed otherwise even though the airflow is not divided into two perfectly. Materials for the rectifying member are also variable.

Additional modifications and variations are possible in light of the above teachings. It is therefore to be understood that, within the scope of the appended claims, the invention may be practiced other than as specifically described herein.

What is claimed is:

1. A fixing device comprising:

a rotary fixing member;

a pressure roller configured to press against the fixing member; and an induction heating unit to heat the fixing member, wherein the induction heating unit comprises:

an excitation coil;

a coil retainer to hold the excitation coil; and a cover member disposed opposite the coil retainer in an opposite side of the fixing member, wherein the cover member protrudes toward a central predetermined range of the excitation coil in an axial direction of the rotary fixing member.

2. The fixing device as claimed in claim 1, wherein the central predetermined range comprises at least a linear portion of the excitation coil disposed to extend in the axial direction of the fixing member.

3. The fixing device as claimed in claim 2, wherein the cover member includes a projecting portion extending toward the coil retainer that narrows the distance between the coil retainer and the cover member.

4. The fixing device as claimed in claim 3, wherein the projecting portion has a slanted surface opposite a cooled air inlet to the induction heating unit.

5. The fixing device as claimed in claim 4, wherein the excitation coil has a curved portion of the excitation coil extending from and connecting to the coil linear portion, and the slanted surface of the projecting portion is disposed facing the curved portion of the excitation coil.

6. The fixing device a claimed in claim 3, wherein the projecting portion is formed entirely as a slanted surface.

7. The fixing device as claimed in claim 1, wherein the cover member blocks electromagnetic waves from the excitation coil.

8. The fixing device as claimed in claim 1, wherein the cover member houses the induction heating unit.

9. The fixing device as claimed in claim 1, further comprising ventilation means to send cooled air between the coil retainer and the cover member.

10. An image forming apparatus comprising a fixing device as claimed in claim 1.

11. A fixing device comprising:

a rotary fixing member;

a pressure roller configured to press against the fixing member; and an induction heating unit to heat the fixing member, wherein the induction heating unit comprises:

an excitation coil;

a coil retainer to hold the excitation coil;

a cover member disposed opposite the coil retainer in an opposite side of the fixing member;

a rectifying member protruding from the cover member toward the coil retainer; and an airflow path between the cover member and the coil retainer, wherein the rectifying member narrows the airflow path.

12. The fixing device as claimed in claim 11, wherein the rectifying member is disposed near one end of the cover member and to one side of a cooled air inlet to the induction heating unit.

13. The fixing device as claimed in claim 12, wherein the rectifying member has a slanted surface opposite the cooled air inlet.

14. The fixing device as claimed in claim 11, wherein the excitation coil has a curved surface portion and a distance between the rectifying member and the curved surface portion of the excitation coil upstream in the airflow path is shorter than that downstream in the airflow path.

15. The fixing device as claimed in claim 11, wherein the rectifying member is made of a thermally conductivity material.

16. A fixing device comprising:

a rotary fixing member;

a pressure roller configured to press against the fixing member; and an induction heating unit to heat the fixing member, wherein the induction heating unit comprises a rectifying member to divide air flowing into the induction heating unit into two currents, disposed inside the induction heating unit between the excitation coil-mounted surface and an opposite surface thereof and at an inner side of the excitation coil.

17. The fixing device as claimed in claim 16, wherein the rectifying member is disposed along a longitudinal direction of the induction heating unit and sends the air that has been divided into two currents along the linear, longitudinal direction of the excitation coil.

18. The fixing device as claimed in claim 16, wherein the rectifying member has a curved or sharply-angled end surface upstream in an airflow path.

19. The fixing device as claimed in claim 16, further comprising a coil retainer, wherein the rectifying member and the coil retainer to hold the excitation coil form a single integrated unit.

20. An image forming apparatus comprising a fixing device as claimed in claim 16.

* * * * *